US007470004B2

(12) United States Patent
Eguchi et al.

(10) Patent No.: US 7,470,004 B2
(45) Date of Patent: Dec. 30, 2008

(54) LIQUID EJECTION HEAD AND LIQUID EJECTION DEVICE

(75) Inventors: Takeo Eguchi, Kanagawa (JP); Takaaki Miyamoto, Kanagawa (JP); Manabu Tomita, Kanagawa (JP); Shogo Ono, Kanagawa (JP); Kazuyasu Takenaka, Tokyo (JP); Iwao Ushinohama, Kanagawa (JP); Minoru Kohno, Tokyo (JP)

(73) Assignee: Sony Corporation, Tokyo (JP)

( * ) Notice: Subject to any disclaimer, the term of this patent is extended or adjusted under 35 U.S.C. 154(b) by 332 days.

(21) Appl. No.: 11/068,131

(22) Filed: Feb. 28, 2005

(65) Prior Publication Data

US 2005/0200662 A1 Sep. 15, 2005

(30) Foreign Application Priority Data

Mar. 1, 2004 (JP) ..... 2004-056006
Jun. 10, 2004 (JP) ..... 2004-171987

(51) Int. Cl.
*B41J 2/05* (2006.01)

(52) U.S. Cl. ..... 347/65; 347/94

(58) Field of Classification Search ..... 347/20, 347/56, 61–65, 84–87, 92–94
See application file for complete search history.

(56) References Cited

U.S. PATENT DOCUMENTS 5,755,032 A 5/1998 Pan et al. ..... 347/65
6,244,694 B1 * 6/2001 Weber et al. ..... 347/65
6,247,798 B1 6/2001 Cleland et al. ..... 347/65
2002/0057315 A1 5/2002 Touge et al. ..... 347/65
2004/0125175 A1 7/2004 Yang et al. ..... 347/65

FOREIGN PATENT DOCUMENTS

| | | |
|---|---|---|
| EP | 0737580 | 10/1996 |
| EP | 0842776 | 5/1998 |
| EP | 0921001 | 6/1999 |
| JP | 04-305460 | 10/1992 |
| JP | 07-089074 | 4/1995 |
| JP | 07-125209 | 5/1995 |
| JP | 07-164640 | 6/1995 |
| JP | 08-067006 | 3/1996 |
| JP | 09207336 | 8/1997 |
| JP | 2002-086736 | 3/2002 |
| JP | 2002-144580 | 5/2002 |
| JP | 2003-191469 | 7/2003 |
| TW | 550233 | 9/2003 |

* cited by examiner

*Primary Examiner*—Juanita D Stephens
(74) *Attorney, Agent, or Firm*—Rockey, Depke & Lyons, LLC; Robert J. Depke

(57) ABSTRACT

A flow path structure includes a heating element, a barrier layer, a liquid chamber formed by a part of the barrier layer and a pair of walls confronting each other to hold the heating element therebetween and a first individual flow path and a second individual flow path disposed on both the sides of the liquid chamber to communicate with the liquid chamber, a liquid is supplied to the liquid chamber from at least one of first and second individual flow paths, and the distance U between the walls in the liquid chamber and the flow path width W of the first individual flow path are set to satisfy U>W. With this arrangement, a flow path structure can be provided in which a failure in flow paths due to dusts is unlike to occur and which minimizes the influence of bubbles and has almost no uneven ejection.

15 Claims, 22 Drawing Sheets

EMBODIMENT CORRESPONDING TO FIG. 3

EMBODIMENT CORRESPONDING TO FIG. 11

LIQUID EJECTION HEAD AND LIQUID EJECTION DEVICE

The present application claims priority to Japanese Patent Application(s) JP2004-056006, filed in the Japanese Patent Office Mar. 1, 2004, and JP2004-171987, filed in the Japanese Patent Office Jun. 10, 2004; the entire contents of which are incorporated herein by reference.

BACKGROUND OF THE INVENTION

1. Field of the Invention

The present invention relates to a thermal system liquid ejection head used in an inkjet printer and the like and to a liquid ejection device such as an inkjet printer and the like including the liquid ejection head, and relates to a technology for realizing a flow path structure without uneven ejection by minimizing a flow path failure caused by intrusion of dusts and the like and occurrence of bubbles.

2. Description of the Related Art

Heretofore, in a liquid ejection head used in a liquid ejection device represented by, for example, an inkjet printer, there is known a thermal system making use of expansion and contraction of generated bubbles and a piezo system making use of fluctuation of the shape and the volume of a liquid chamber.

In the thermal system, heating elements are disposed on a semiconductor substrate, bubbles are generated to a liquid in a liquid chamber, the liquid is ejected from nozzles disposed on the heating elements as liquid droplets, and the liquid droplets are landed on a recording medium and the like.

FIG. 25 is an outside perspective view of this type of a conventional liquid ejection head 1 (hereinafter, simply referred to a head 1) In FIG. 25, a nozzle sheet 17 is bonded on a barrier layer 3, and FIG. 25 shows the nozzle sheet 17 by disassembling it.

FIG. 26 is a sectional view showing a flow path structure of the head 1 shown in FIG. 25. Note that this type of the flow path structure of the liquid ejection device is disclosed in, for example, Japanese Unexamined Patent Application Publication No. 2003-136737.

In FIGS. 25 and 26, a plurality of heating elements 12 are disposed on a semiconductor substrate 11. Further, the barrier layer 3 and the nozzle sheet 17 are sequentially laminated on the semiconductor substrate 11. A member, in which the heating elements 12 as well as the barrier layer 3 are formed on the semiconductor substrate 11, is called a head chip 1*a*. A member, in which the nozzle sheet 17 is bonded on the head chip 1*a*, is called the head 1.

The nozzle sheet 17 has nozzles 18 (holes for ejecting liquid droplets) which are disposed to position on the heating elements 12. Further, the barrier layer 3 is disposed on the semiconductor substrate 11 so as to be interposed between the heating elements 12 and the nozzles 18 so that liquid chambers 3*a* are formed between the heating elements 12 and the nozzles 18.

As shown in FIG. 25, the barrier layer 3 is formed in a comb shape when viewed in a plan view so that three sides of the heating elements 12 are surrounded thereby. With this arrangement, liquid chambers 3*a* are formed with only one sides thereof opened.

Individual flow paths 3*d* are formed to the open portions and communicate with a common flow path 23.

The heating elements 12 are disposed in the vicinity of a side of the semiconductor substrate 11. In FIG. 26, a dummy chip D is disposed on the left side of the semiconductor substrate 11 (head chip 1*a*), thereby the common flow path 23 is formed by a side surface of the semiconductor substrate 11 (head chip 1*a*) and a side surface of the dummy chip D. Note that any member may be used in place of the dummy chip D as long as it can form the common flow path 23.

As shown in FIG. 26, a flow path sheet 22 is disposed on the surface of the semiconductor substrate 11 opposite to that on which the heating elements 12 are disposed. As shown in FIG. 26, an ink supply port 22*a* and a supply flow path 24 are formed to the flow path sheet 22. The supply flow path 24 has an approximately concave sectional shape so as to communicate with the ink supply port 22*a*. The supply flow path 24 communicates with the common flow path 23.

With the above arrangement, ink is supplied from the ink supply port 22*a* to the supply flow path 24 and the common flow path 23 as well as enters the liquid chambers 3*a* through the individual flow path 3*d*. When the heating elements 12 are heated, bubbles are generated on the heating elements 12 in the liquid chambers 3*a*, thereby a part of the liquid in the liquid chambers 3*a* is ejected from the nozzles 18 by trajectory force when the bubbles are generated.

Note that, in FIGS. 25 and 26, the shapes of the respective components are exaggeratedly shown ignoring the actual shapes thereof for the sake of easy understanding. For example, the thickness of the semiconductor substrate 11 is about 600-650 μm, and the thickness of the barrier layer 3 is about 10-20 μm.

In the head 1 of the conventional technology described above, a problem arises in that, first, the liquid fails to be ejected from the nozzles 18 and is supplied to the flow paths in an insufficient amount because dusts and the like come into the flow paths and the nozzles 18.

Dust and the like float and move freely in an ordinary space. Accordingly, they drop in the liquid and exist therein as dusts and the like. In liquid ejection devices such as inkjet printers and the like, however, the nozzles 18 may be clogged with dusts and the like because the structure thereof is such that a liquid is ejected from nozzles 18 having a diameter of several microns.

To cope with the above problem, at present, parts are rinsed with a liquid and the like containing a less amount of dusts and the like in a working atmosphere, for example, in a clean room, and the like in a manufacturing process.

Further, in design, filters must be disposed in the flow paths of the liquid ejection device at several positions to eliminate dusts and the like.

In particular, since an increase in the number of nozzles as in a line head increases the probability of failed injection of a liquid from the nozzles 18, dusts and the like must be more strictly managed, from which a problem of an increase in cost arises.

Further, bubbles may be generated in the liquid as a result of an increase in the temperature of the head 1, from which a problem arises in that the liquid is ejected in an insufficient amount due to the bubbles.

Although the common flow path 23 and the individual flow paths 3*d* are exemplified as the positions where bubbles are generated, the liquid is ejected unevenly even if they are generated in any of the positions.

FIG. 27 is a photograph showing the state of bubbles remaining in a common flow path 23.

In FIG. 27, the nozzle sheet 17 is formed of a transparent member so that the state of the bubbles in the nozzle sheet 17 can be observed.

In FIG. 27, a filter is disposed in the common flow path 23. The filter is disposed to prevent invasion of dusts and the like in the individual flow paths 3*d*, and composed of column-shaped pillars disposed along the common flow path 23.

As shown in FIG. 27, the amount of the liquid supplied to the individual flow path 3*d* is reduced in the region (the region surrounded by a dotted line) in which bubbles remain in the common flow path 23. Accordingly, the amount of ejection of the liquid is reduced, thereby an unevenly ejected liquid having a reduced density appears in a wide region.

Note that, as a reason why the ejected state of the liquid is affected by bubbles, it is contemplated that the ejection of the liquid itself is affected by pressure generated in the ejection and a reaction which corresponds to the pressure and is determined by the liquid in the vicinity of the liquid chamber 3*a*, the barrier layer 3, and the existence of the bubbles.

Further, bubbles may come into the vicinities of the inlets of the individual flow paths 3*d* and into the individual flow paths 3*d*. FIG. 28 is a photograph showing the state of bubbles remaining in the inlet of the individual flow path 3*d*. In FIG. 28, the nozzle sheet 17 is formed of a transparent member likewise in FIG. 27.

In this case, even if bubbles are small in size, they have a significant influence because they exist in a small space. That is, the amount of ejection of the liquid is more reduced than the state shown in FIG. 27. Further, only the amount of ejection of the liquid from the nozzle 18 corresponding to the individual flow path 3*d* into which bubbles come is reduced, the liquid becomes conspicuous as a stripe.

When the bubbles described above are generated once, they are adhered to the common flow path 23 and the individual flow paths 3*d* or reciprocatingly move between the common flow path 23 and the individual flow paths 3*d* and do not simply disappear even if the liquid is repeatedly ejected. Further, since the liquid is supplied into the liquid chambers 3*a* passing among the bubbles, insufficient ejection characteristics are often maintained fixedly.

Note that it is confirmed that bubbles disappear when an ejecting operation is stopped and the temperature of the liquid is lowered by being left for a long period of time, from which it can be found that the bubbles in this case are generated by the evaporation of the liquid.

In contrast, since a portion surrounded by a bubble is composed of a gas, it has a bad coefficient of thermal conductivity, thereby the heat of a heating portion is liable to be accumulated in the portion because it is not cooled by the liquid. As a result, a problem arises in that the bubble is expanded.

Since there is a tendency that bubbles are particularly liable to be generated when the center of the heating element 12 is displaced from that of the nozzle 18, it is also contemplated that the bubbles generated on the heating element 12 remain without being effectively used for ejection.

Further, bubbles may come into the liquid chambers 3*a* and the nozzles 18. FIG. 29 is a photograph showing the state in which a gas comes into the liquid chambers 3*a* from nozzles 18.

In FIG. 29, although a filter (triangular-prism-shaped pillars are disposed different from the column-shaped pillars in FIG. 27) is disposed in the common flow path 23, since the spaces between the pillars of the filter are clogged with bubbles which are combined with each other and grown, the liquid cannot move to the liquid chambers 3*a* side.

When the movement of the liquid from the common flow path 23 to the liquid chambers 3*a* is checked by the bubbles, the balance of the meniscuses of the nozzles 18 is liable to be broken. In this state, impact waves from adjacent nozzles trigger a gas to come into the liquid chamber 3*a* of the nozzle 18. That is, since the pressure of the liquid in the head 1 is set lower than atmospheric pressure, when the balance of meniscuses is broken, the liquid moves backward to the common flow path 23 side and cannot be ejected.

Further, there is also a problem in that the liquid is ejected unevenly by the impact waves in ejection coupled particularly with the existence of bubbles. Note that, in the thermal system, the pressure in ejection is more significantly changed as compared with the piezo system.

The following two problems are exemplified as problems caused by impacts in ejection.

First, impact waves trigger to cause bubbles to be drawn from adjacent liquid chambers 3*a*.

It is contemplated to increase the intervals between the pillars of the filter to avoid this problem. In the case, however, since the size of dusts and the like passing through the filter is increased, large dusts and the like are liable to come into the individual flow paths 3*d*.

Second, since the impact waves are transmitted to adjacent nozzles 18, the meniscuses of the nozzles 18 are vibrated to thereby cause uneven liquid ejection. When bubbles are generated or remain, they are encountered with the impact waves, thereby the bubbles are liable to be drawn and the uneven liquid ejection is liable to be caused.

Incidentally, in a serial system in which an image can be formed by overlapping dots (overlapped writing), even if there are one or two nozzles which eject the liquid unevenly, the uneven liquid ejection can be recovered by making it inconspicuous by the overlapped writing. In contrast, in a line system, in which image formation is completed by ejecting droplets once and the overlapped writing cannot be executed in principle, the uneven liquid ejection cannot be recovered different from the serial system.

SUMMARY OF THE INVENTION

In the present invention, the above problems are solved by the following solving means.

The present invention is a liquid ejection unit which includes a heating element disposed on a semiconductor substrate, a nozzle layer through which a nozzle located on the heating element is formed, a barrier layer interposed between the semiconductor substrate and the nozzle layer, a liquid chamber formed by a part of the barrier layer as well as formed by a pair of walls confronting each other so as to hold the heating element, and a pair of individual flow paths formed by extending the pair of walls of the liquid chamber and disposed on both the sides of the liquid chamber so as to communicate with the liquid chamber. In the liquid ejection head, a liquid is supplied to the liquid chamber from at least one of the pair of individual flow paths, and the distance U between the pair of walls in the liquid chamber and the flow path width W of the individual flow paths are set to satisfy the relation U>W.

In the above invention, the liquid ejection head is provided with two individual flow paths connecting to the liquid chamber. Further, the width of the liquid chamber is formed larger than the flow path width of the individual flow paths. Accordingly, even if bubbles are generated in one of the individual flow paths and a liquid cannot be supplied to the liquid chamber therefrom, the liquid can be supplied thereto from the other individual flow path. Further, even if the two individual flow paths are provided, pressure necessary to eject the liquid can be maintained by making the flow path width of the individual flow paths narrower than the width of the liquid chamber.

Note that although the nozzle layer and the barrier layer are arranged as separate members (barrier layer 13 and nozzle sheet 17) in the following embodiments, they may be formed integrally with each other.

DESCRIPTION OF THE PREFERRED EMBODIMENTS

The inventors of this application have proposed a technology for reducing the influence of impact waves of the problems of uneven liquid ejection in Japanese Patent Application No. 2003-348709 which is a prior application that is not published and have proposed a technology for minimizing the ratio of occurrence of bubbles in Japanese Patent Application No. 2004-014183 which is a prior application that is not published.

An object of the present invention is to provide a flow path structure having almost no uneven liquid ejection by making a failure of flow paths due to dusts and the like to unlikely occur as well as minimizing the influence of bubbles by further improving the conventional technologies described above on the basis of the technologies.

A first embodiment of the present invention will be explained below with reference to the drawings and the like.

A liquid ejection device of the present invention is an inkjet printer (which is a color printer employing a thermal system and hereinafter simply referred to as "printer") in the embodiment, and a liquid ejection head is a line head 10 in the embodiment.

Figure 1:
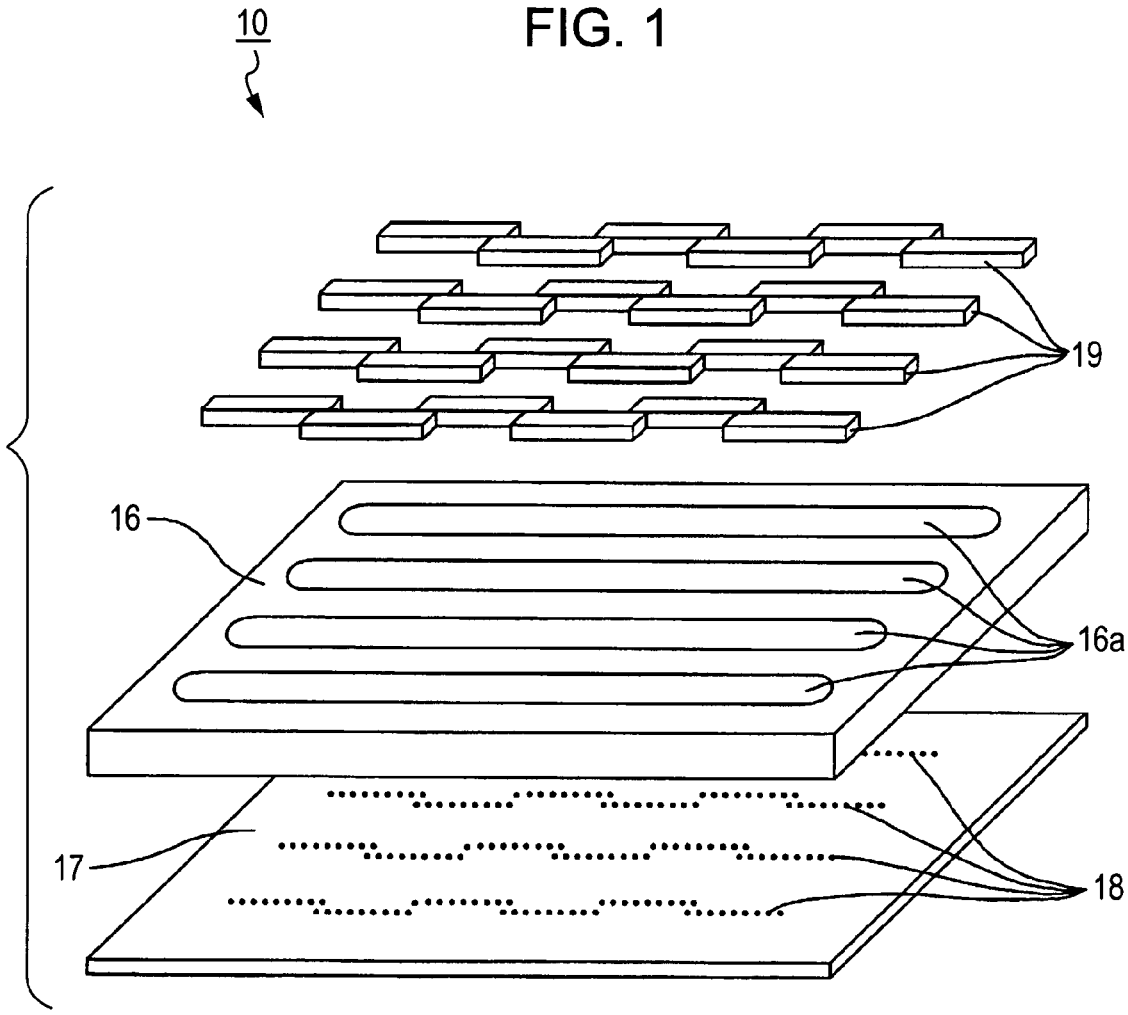
FIG. 1 is an outside perspective view showing a line head of an embodiment.

FIG. 1 is an outside perspective view showing the line head 10 of the embodiment. The line head 10 is arranged such that head chip 19 trains, each of which is composed of head chips 19 as long as the width of an A4 size print sheet and arranged in line, are disposed in four columns. Each row of the head chips 19 acts as a four-color head of Y (yellow), M (magenta), C (greenish-blue), and K (black).

The line head 10 is formed such that a plurality of the head chips 19 are disposed in parallel with each other zigzag and the lower portions of the head chips 19 are bonded to a single nozzle sheet 17 (nozzle layer). The respective nozzles 18 formed on the nozzle sheet 17 are disposed at the positions corresponding to the heating elements 12 (to be described later) of all the head chips 19 (specifically, so that the center axial lines of the heating elements 12 are in coincidence with the center axial lines of the nozzles 18). Note that each of the heating elements 12 is composed of a single heating element in the embodiment, it is needless to say that the present invention is not limited thereto. That is, each heating element 12 may be divided into a plurality of portions such as two portions.

A head frame 16 is a support member for supporting the nozzle sheet 17 and formed in a size corresponding to the nozzle sheet 17. The head frame 16 has accommodation spaces 16*a* whose size is determined in coincidence with the lateral width (about 21 cm) of A4 size.

Each of the four rows of the head chip 19 trains is disposed in each of the accommodation spaces 16*a* of the head frame 16. An ink tank, in which different color ink is accommodated, is attached to each of the accommodation spaces 16*a* of the head frame 16 on the back surfaces of the head chips 19, thereby ink having different colors is supplied to the respective accommodation spaces 16*a*, that is, to the respective head chip 19 trains.

Figure 2A:
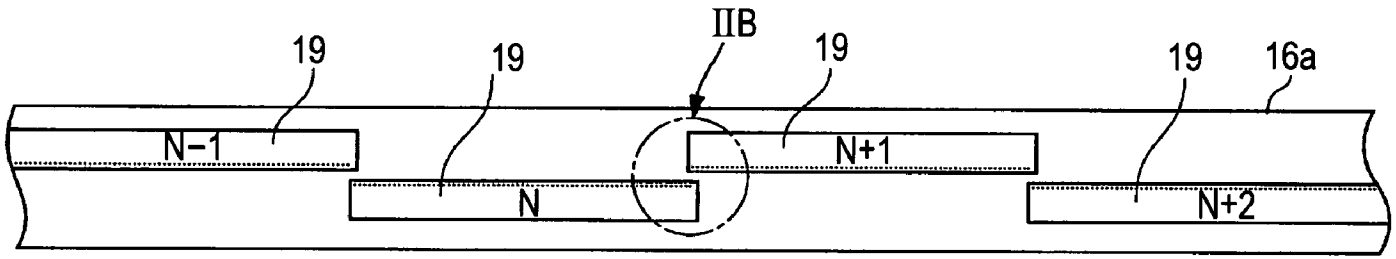
FIGS. 2A and 2B are plan views showing one head chip train.
Figure 2B:
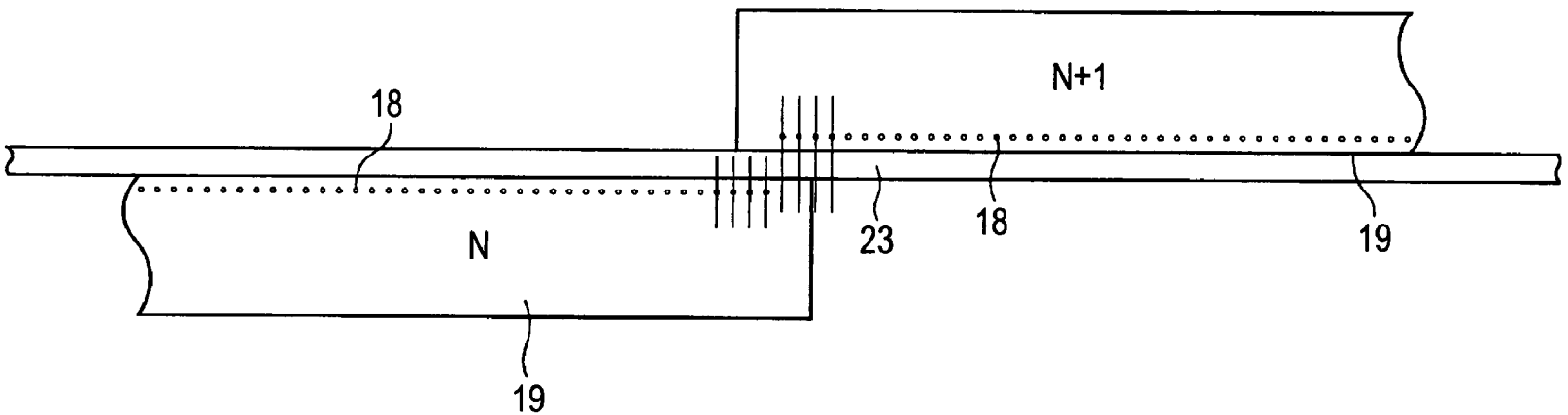

FIGS. 2A and 2B are plan views showing one head chip 19 train. In FIGS. 2A and 2B, the head chips 19 are shown by being overlapped on the nozzles 18.

The respective head chips 19 are disposed zigzag, that is, they are disposed such that the directions of adjacent head chips 19 are inverted 1800 each other. As shown in FIGS. 2A and 2B, a common flow path 23 is formed between "N−1"th and "N+1"th head chips 19 and "N"th and "N+2"th head chips 19 so that the ink is supplied to all the head chips 19.

Further, as shown in FIGS. 2A and 2B, the respective nozzles 18 are disposed at the same interval including the portions thereof adjacent with each other zigzag.

The line head 10 arranged as described above is fixed in a printer main body, and a recording medium is moved relatively with respect to the line head 10 while keeping a predetermined interval between a surface (ink landing surface) of the recording medium and the ink ejection surface of the line head 10 (surface of the nozzle sheet 17). Characters, images, and the like are printed in color by disposing dots on the recording medium by ejecting ink from the respective nozzles 18 of the head chips 19 during the relative movement between the recording medium and the line head 10.

Next, the head chip 19 of the embodiment will be explained in more detail. The head chip 19 is the same as the conventional head chip 1*a* in that the heating elements 12 are disposed on a semiconductor substrate 11. However, the shape of a barrier layer 13 disposed on the semiconductor substrate 11 is different from that of the conventional head chip 1*a*. A reason why the shape of the barrier layer 13 is different resides in that liquid chambers 13*a* and first and second individual flow paths 13*d* and 13*e* are formed in a different shape.

Figure 3:
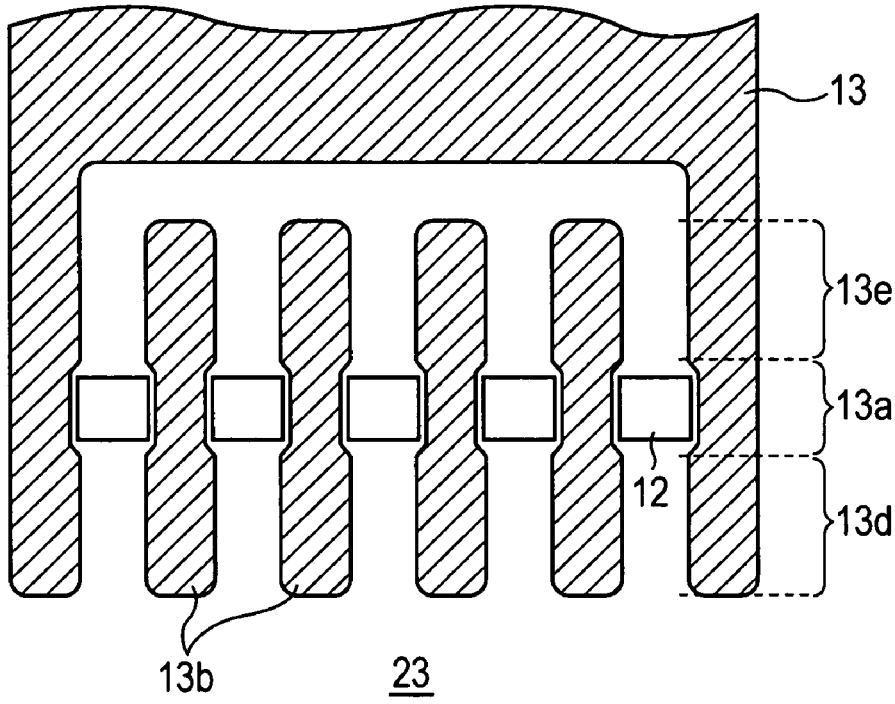
FIG. 3 is a plan view showing the shape of a barrier layer of a head chip of the embodiment.

FIG. 3 is a plan view showing the shape of the barrier layer 13 of the head chip 19 of the embodiment.

The heating elements 12 are disposed on the semiconductor substrate likewise those in the conventional technology. A pair walls 13*b* are disposed on both the sides of each heating element 12 by a portion of the barrier layer 13. That is, pairs of walls 13*b* are disposed on both the sides of the heating elements 12 in the direction in which they are disposed (lateral direction in FIG. 3), and the heating elements 12 are disposed between the pairs of walls 13*b* as well as the liquid chambers 13*a*, the first individual flow path 13*d*, and the second individual flow path 13*e* are formed by the pairs of walls 13*b*.

In the embodiment, each liquid chamber 13*a* contains the region of the heating element 12 and has an octagonal pillar region having a bottom composed of an octagonal region formed by chamfering the four corners of a rectangular region slightly (one size) larger than the region of the heating element 12. It is needless to say that the octagonal pillar region of the liquid chamber 13*a* is not limited to that described above.

Further, the individual flow paths communicating with the liquid chambers 13*a* are formed by the pairs of walls 13*b*. In the embodiment, the individual flow paths extend in a direction perpendicular to the direction in which the heating elements 12 are disposed (up/down direction in the figure). Note that the term "vertical" means substantially vertical and includes non-perfectly vertical near to vertical (approximately vertical), in addition to physically perfectly vertical (which is applied to the following description likewise).

Figure 25:
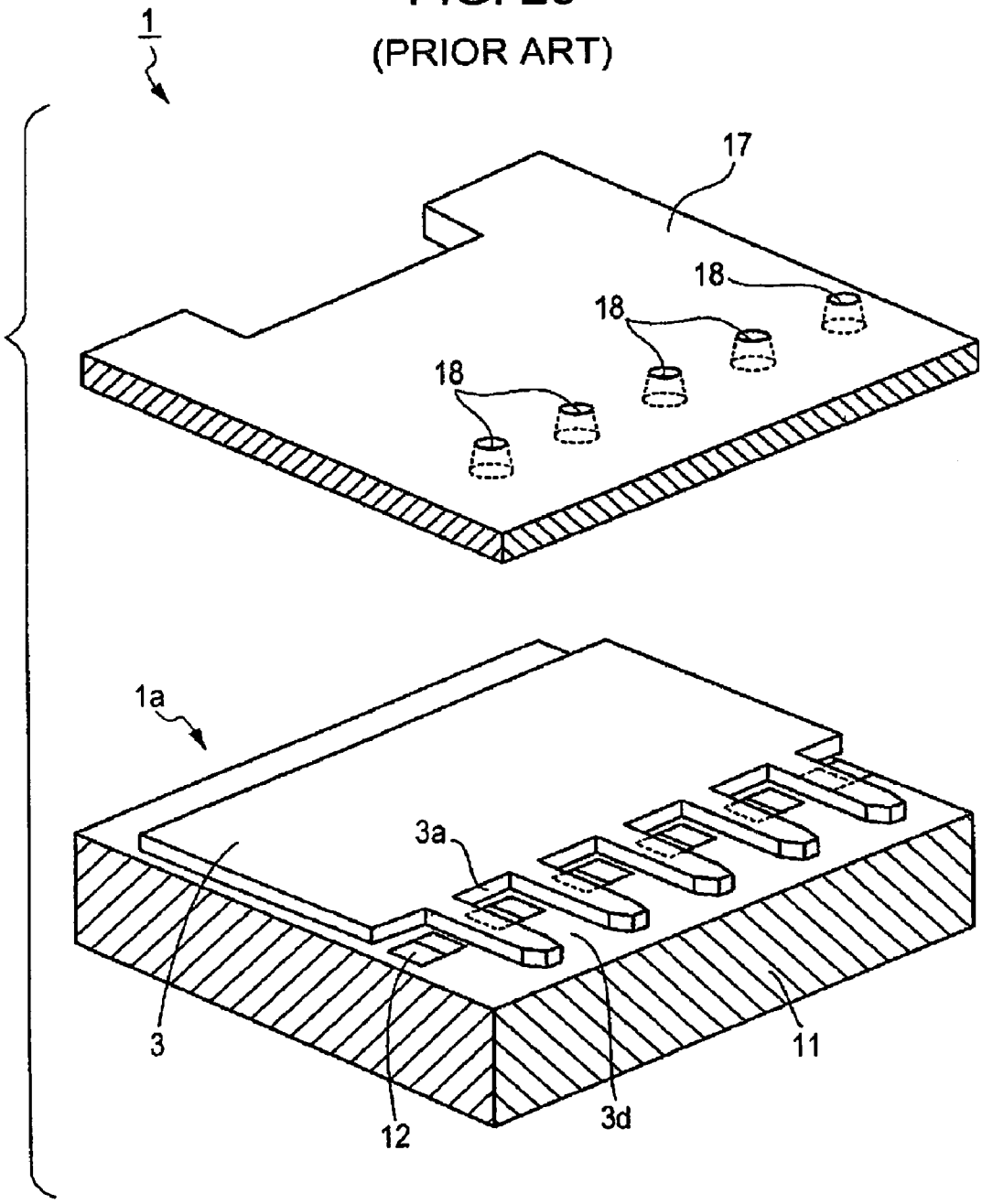
FIG. 25 (PRIOR ART)
FIG. 25 is an outside perspective view showing a conventional liquid ejection head.
Figure 26:
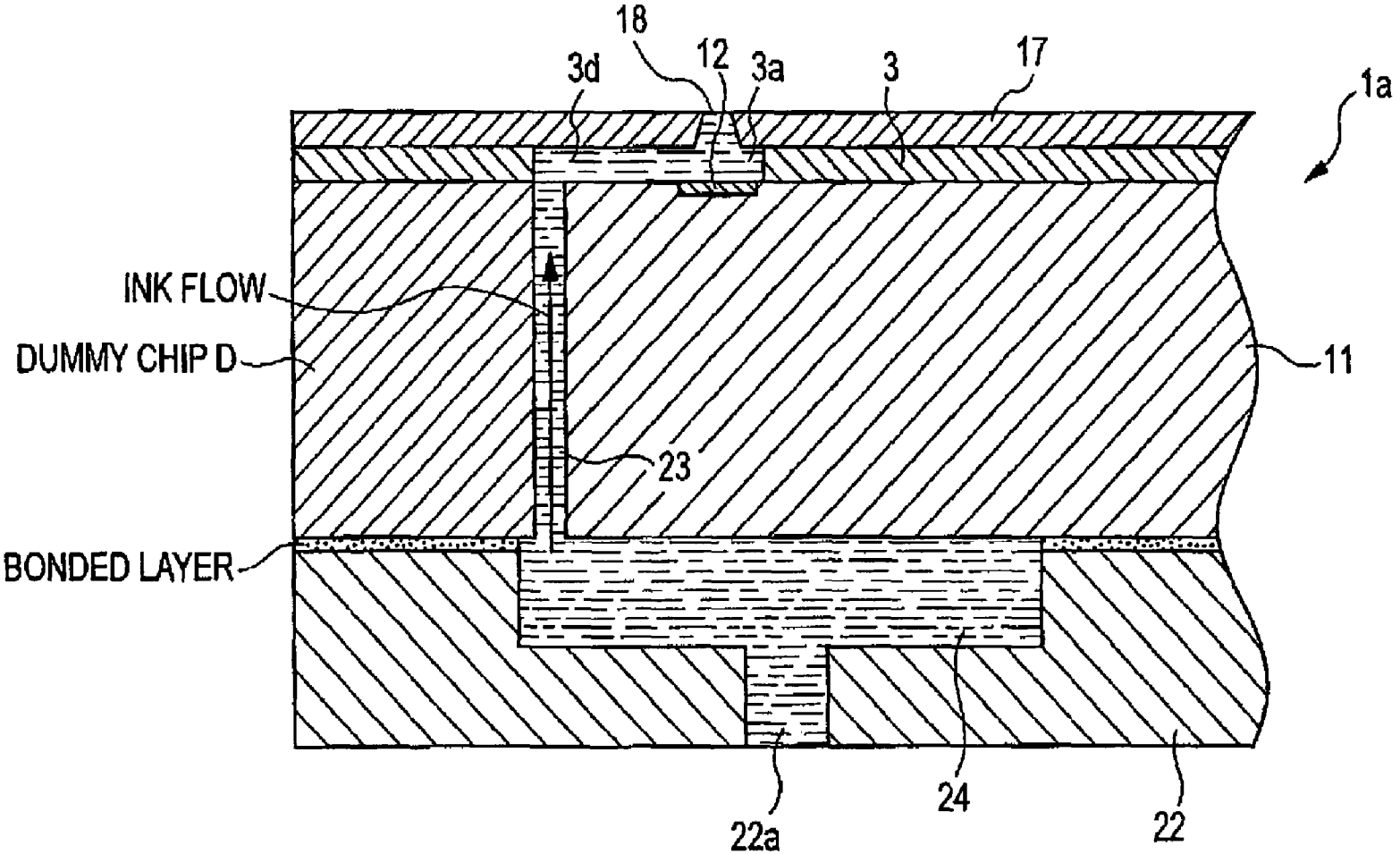
FIG. 26 (PRIOR ART)
FIG. 26 is a sectional view showing a flow path structure of the head shown in FIG. 25.
Figure 27:
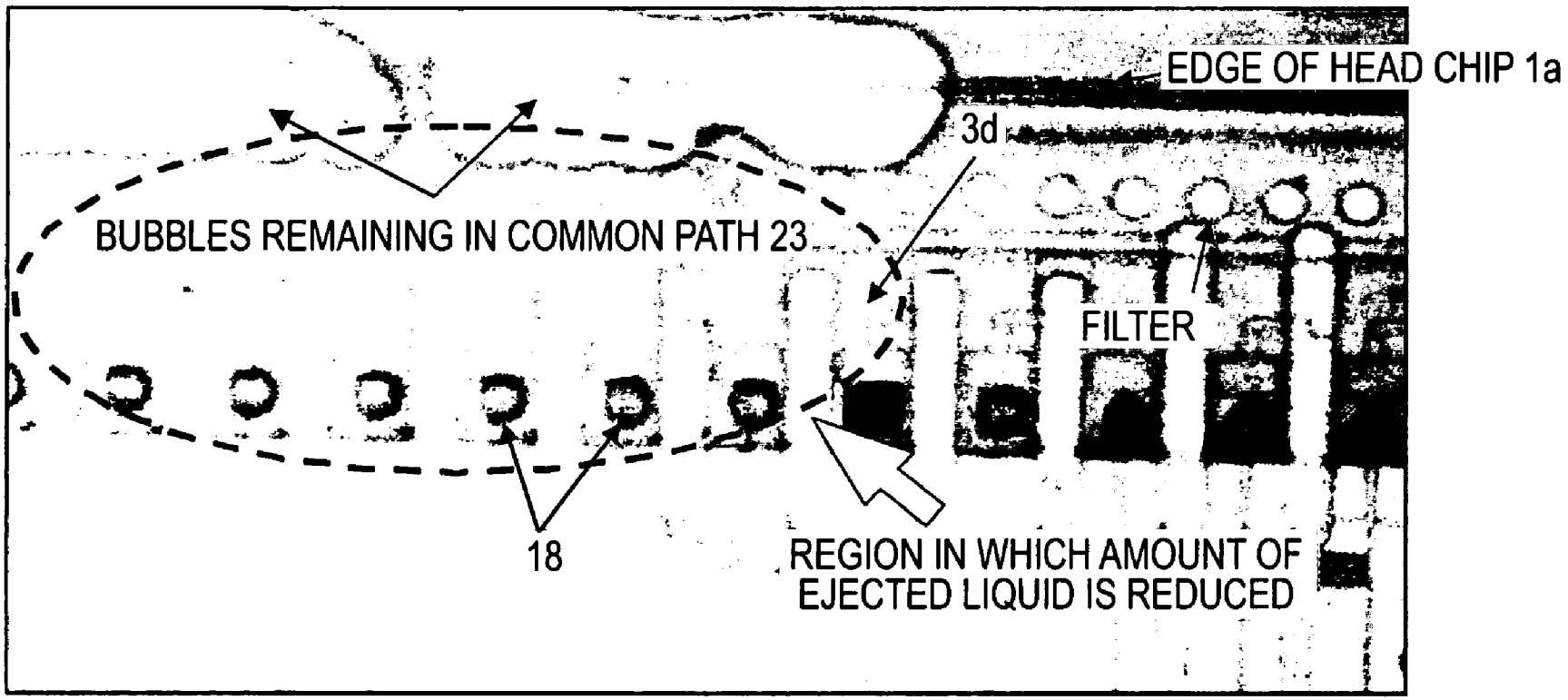
FIG. 27 is a photograph showing the state of bubbles remaining in a common flow path.
Figure 28:
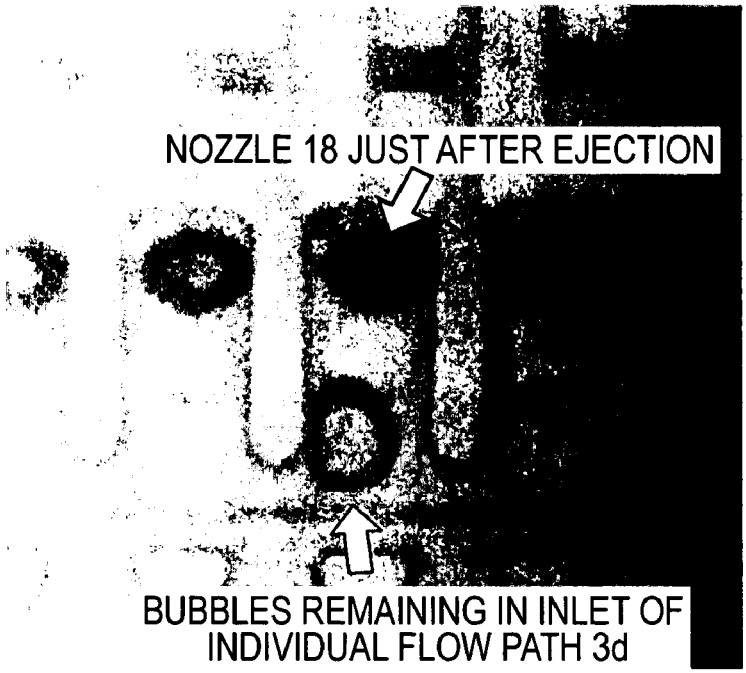
FIG. 28 is a photograph showing the state of bubbles remaining in the inlet of an individual flow path.
Figure 29:
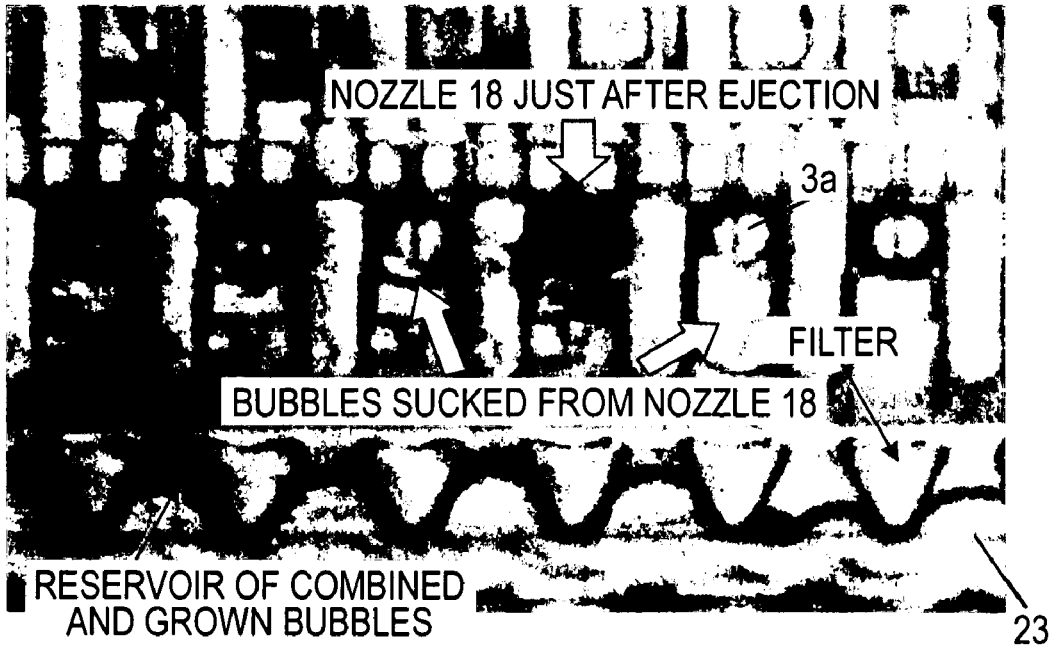
FIG. 29 is a photograph showing the state in which a gas comes into the liquid chambers from nozzles.

The individual flow paths are composed of the first individual flow paths 13*d*, and the second individual flow paths 13*e* which extend in a direction opposite to the individual flow paths 13*d* across the liquid chambers 13*a*. The individual flow paths 13*d* corresponds to the individual flow paths 3*d* shown in the conventional technology (FIG. 25).

With the above arrangement, all the liquid chambers 13*a* are connected to the first individual flow paths 13*d* and the second individual flow paths 13*e*. Further, all the first individual flow path 13*d* are connected to the common flow path 23. Furthermore, all the individual flow paths 13*e* are coupled with each other.

Figure 4:
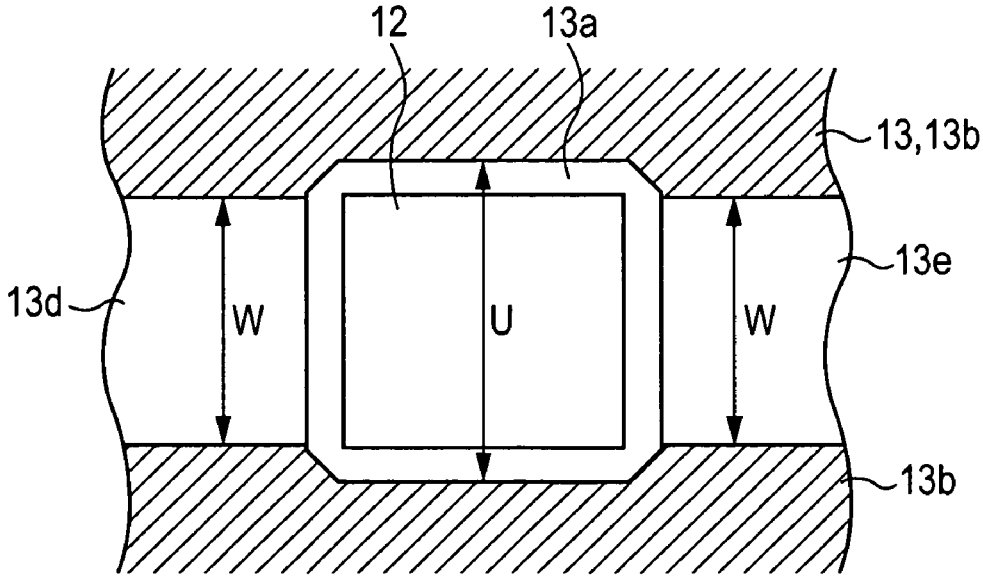
FIG. 4 is a plan view showing the relation between the width U of a liquid chamber and the flow path width W of first and second individual flow paths.

FIG. 4 is a plan view showing the relation between the width U of the liquid chamber 13*a* and the flow path width W of the first and second individual flow paths 13*d* and 13*e*.

As shown in FIG. 4, the distance between the pair of walls 13*b* disposed on both the sides of the liquid chamber 13*a* is defined as the width U of the liquid chamber 13*a*, and the flow path width of first and second individual flow paths 13*d* and 13*e* is defined as W. Note that the width of the liquid chamber 13*a* is U in the region which includes approximately the entire region of the liquid chamber 13*a* and is located on at least the heating element 12. However, as shown in FIG. 4, the width of the liquid chamber 13*a* is partly narrower than U. Further, the flow path width of the first and second individual flow paths 13*d* and 13*e* are set to W in approximately the entire regions thereof.

In this case, in the embodiment, the width U of the liquid chamber 13*a* and the flow path width W of the first and second individual flow paths 13*d* and 13*e* are formed to satisfy the following relation.

$$U>W$$

They are formed as described above because of the following reason.

Since the region on the heating element 12 is a region in which a liquid is heated and boiled, the wall 13*b* of the barrier layer 13 must be formed not to interfere with the region (so that the barrier layer 13 does not exist in at least the region on the heating element 12). Further, the walls 13*b* are necessary to direct the pressure generated when the liquid on the heating elements 12 is film boiled in the direction of the nozzles 18.

At the time, since the first and second individual flow paths 13*d* and 13*e* are formed in the two directions in the structure of the embodiment, the pressure is dispersed in these directions.

Accordingly, it is contemplated to reduce the width U of the liquid chambers 13*a* and the flow path width W to increase the pressure. Although the width U of the liquid chambers 13*a* cannot be reduced less than the region of the heating element 12, the flow path width W can be reduced within a range in which no drawback occurs. Therefore, in the embodiment, the relation between the width U of the liquid chamber 13*a* and the flow path width W is set to U>W.

Figure 5:
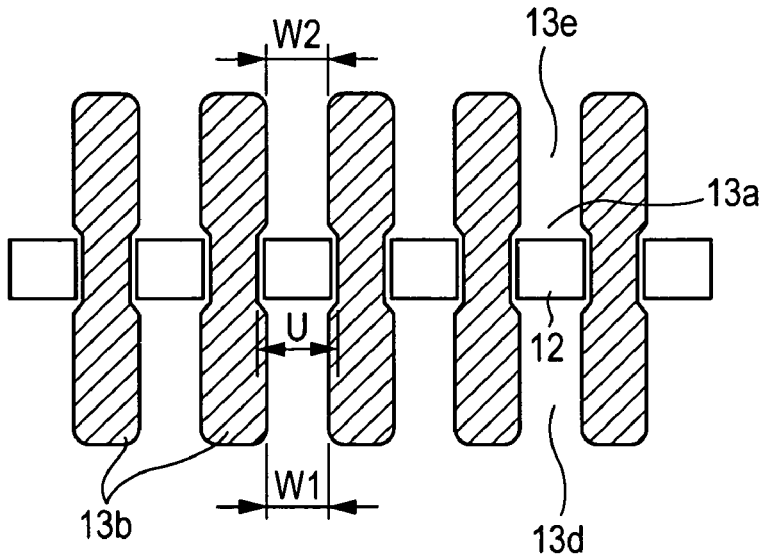
FIG. 5 is a plan view showing the relation among the width U of the liquid chamber, the flow path width W1 of the first individual flow paths and the flow path width W2 of the second individual flow paths.

FIG. 5 is a plan view showing the relation among the width U of the liquid chamber 13*a*, the flow path width W1 of the first individual flow path 13*d*, and the flow path width W2 of the second individual flow path 13*e*.

In the example shown in FIG. 4, when W1=W2=W, the following relation is established.

$$U>W$$

In contrast, the relation of W1≠W2 is also acceptable.

In this case, the width U of the liquid chamber 13*a*, the flow path width W1 of the first individual flow path 13*d*, and the flow path width W2 of the individual flow path 13*e* preferably satisfies the following relation.

$$U>W2\geqq W1$$

Figure 6:
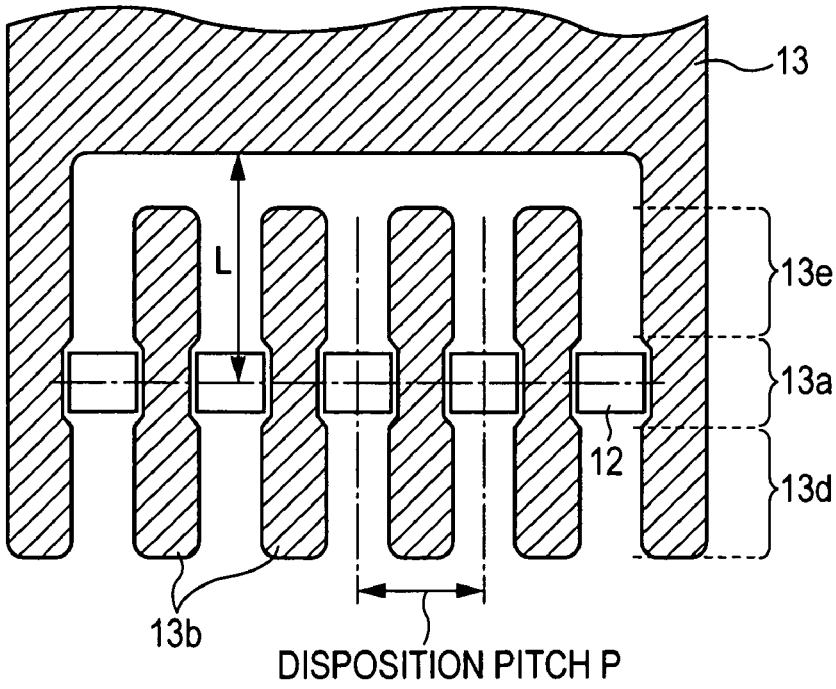
FIG. 6 is a plan view showing the relation between the flow path length of the second individual flow paths and the disposing pitch P of the liquid chambers.

FIG. 6 is a plan view showing the relation between the flow path length of the individual flow paths 13*e* and the disposing pitch P of the liquid chambers 13*a* (this is the same in the heating elements 12 or the nozzles 18).

In FIG. 6, the distance between the line, which connects the centers of the liquid chambers 13*a* in the direction of the disposing pitch P, and the line of the portion, which communicates the second individual flow paths 13*e* between adjacent liquid chamber 13*a* with each other and is in contact with the wall (barrier layer 13) located farthest from the liquid chambers 13*a*, is shown by L.

At the time, the liquid chambers 13*a* are formed to satisfy the following relation.

$$L \leqq 2 \times P$$

They are formed as described above because of the following reason.

When stress (shear stress) is applied to the nozzle sheet 17 in the direction in which the nozzles 18 are arranged due to thermal stress when a temperature increases, force is applied to deform the barrier layer 13. In this case, when the nozzle sheet 17 is bonded to the barrier layer 13 in a large area, the barrier layer 13 is not almost deformed. When the slender individual flow paths (first and second individual flow paths 13*d* and 13*e*) are provided as in the embodiment, the walls 13*b* are liable to be deformed in the barrier layer 13 (this is because the entire length of the individual flow paths is about twice that of the conventional individual flow path 3*d*).

That is, although the walls 13*b* are resistive against shear stress in the direction along the flow path direction of the individual flow paths (direction perpendicular to the direction in which the liquid chambers 13*a* are arranged), it is less resistive against shear stress in the direction perpendicular to the flow path direction of the individual flow paths (direction in which the liquid chamber 13*a* are disposed). With the above arrangement, the nozzles 18 of the nozzle sheet 17 are liable to be relatively displaced from the heating elements 12.

In this case, the length L in FIG. 6 must be set within a definite range to minimize the above deformation. Thus, the deformation is minimized by setting the above relation between L and P.

Note that there is a case in which although the liquid chambers 13*a* are disposed in one direction at the definite disposing pitch P, the liquid chamber 13*a* are not disposed in a line (on a straight line) and the centers of adjacent liquid chamber 13*a* (and also adjacent heating elements 12 or adjacent nozzles 18) are displaced at a predetermined interval X (X is a real number larger than 0) in a direction perpendicular to the disposing pitch P. This technology has been proposed by the applicant (Japanese Patent Application No. 2003-383232).

With the above arrangement, since the distance between the centers of adjacent nozzles 18 is set to a value larger than the disposing pitch P of the liquid chambers 13*a*, the amount of deformation of the nozzles 18 and the peripheral regions thereof due to the pressure fluctuation resulting from ejection of liquid droplets is reduced, thereby the amount ejection and the ejecting direction of liquid droplets can be stabilized.

In this case, when the distance between the line, which connects the centers of the liquid chambers 13*a* disposed on a side far from the common flow path 23 in the plurality of liquid chambers 13*a* (that is, the center line connecting the centers of every other liquid chambers 13*a*), and the line of the portion, which communicates the second individual flow paths 13*e* between adjacent liquid chamber 13*a* with each other and is in contact with the wall (barrier layer 13) located farthest from the liquid chambers 13*a*, is shown by L, the liquid chambers 13*a* are formed to satisfy the above relation ($L \leqq 2 \times P$).

Next, the structure on the common flow path 23 side will be explained.

Figure 7:
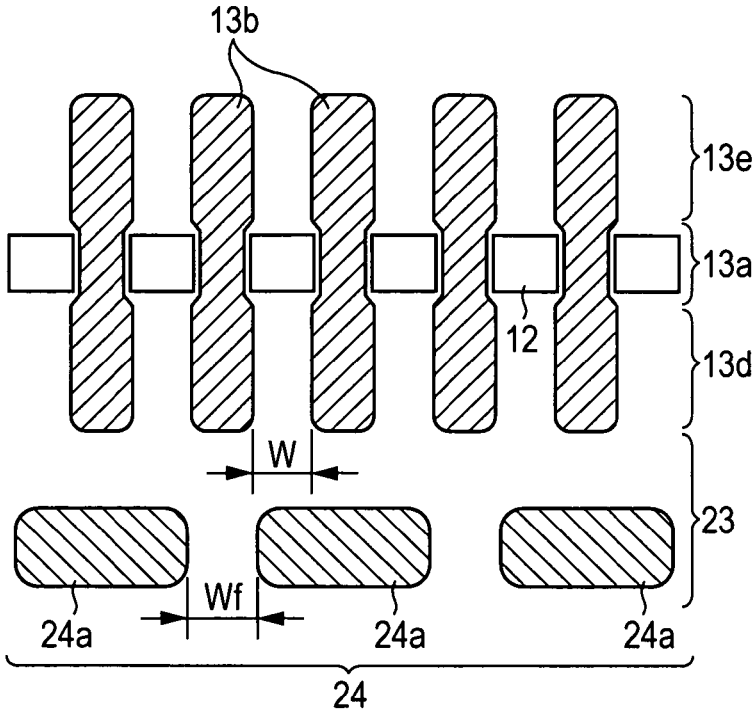
FIG. 7 is a plan view showing the state in which a filter is disposed in a common flow path.

FIG. 3 and the like show nothing in the common flow path 23. However, as shown in FIG. 7 and the like, it is preferable to dispose a filter 24 and the like in the common flow path 23. Note that the filter 24 is formed by the barrier layer 13 (this is also similar in a filter 25 described later).

FIG. 7 is a plan view showing the state in which the filter 24 is disposed in the common flow path 23. The filter 24 is composed of pillars 24*a* disposed in the direction in which the liquid chambers 13*a* are disposed. Each of the pillars 24*a* is formed of an approximately rectangular support pillar in an example shown in FIG. 7. Further, in the example of FIG. 7, the lateral width (length in a lengthwise direction) of the pillar 24*a* is formed to approximately the same length as the length between the outside wall surfaces of a pair of walls 13*b* (flow path width W+thickness of walls 13*b*×2).

Figure 8:
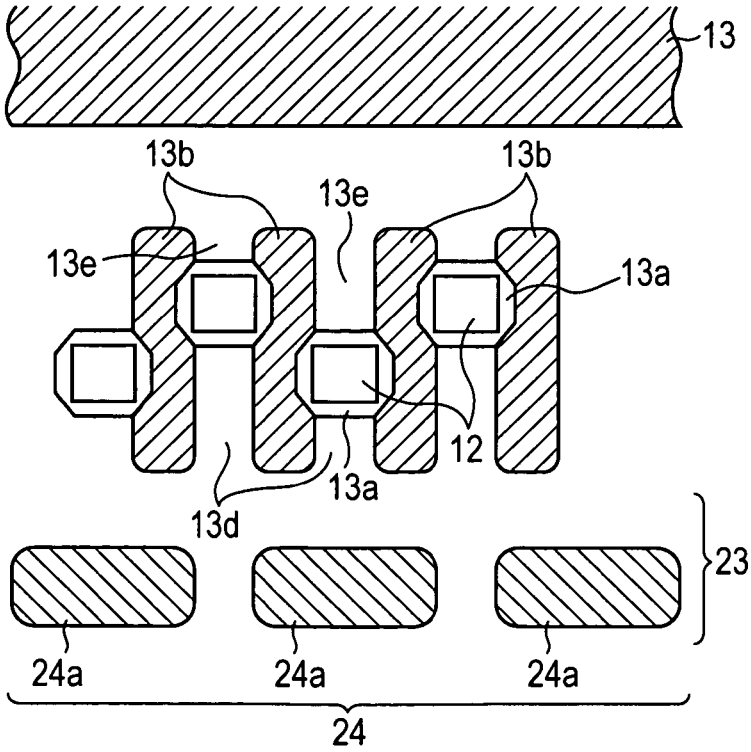
FIG. 8 is a plan view showing that heating elements in FIG. 7 are disposed zigzag.

Incidentally, when the heating elements 12 are disposed zigzag as shown in FIG. 8, the following effects can be obtained.

When the heating elements 12 are disposed zigzag as shown in FIG. 8, there are heating elements 12 near to the filter 24 and heating elements 12 far therefrom. The far heating elements 12 can increase pressure in ejection because they are near to the wall, whereas they take a long time to finish a refill operation because a supply distance is increased in the refill operation. In contrast, although the heating elements 12 near to the filter 24 have a high refill speed, it cannot increase ejection pressure. To cope with the above problem, when the filter 24 as shown in FIG. 8 is disposed, the ejection pressure is increased because the pillars 24*a* of the filter 24 have the same effect as the wall. Further, since the pillars 24*a* of the filter 24 act to delay the refill operation, the difference of ejecting operations can be reduced between the heating elements 12 near to the filter 24 and the heating elements 12 far from the filter 24.

Incidentally, the interval Wf between the pillars 24*a* and the flow path width W of the first individual flow path 13*d* are formed to satisfy the following relation.

$$W \geqq Wf$$

Further, the height of the interval Wf between the pillars 24*a* is set such that it does not exceed the height of the first individual flow path 13*d*.

The height is set as described above so that dusts and the like with which the first individual flow paths 13*d* may be clogged can be removed by the filter 24 located forward of the first individual flow path 13*d*, that is, so that the first individual flow paths 13*d* are not clogged with the dusts and the like having passed through the filter 24.

Note that since the liquid is supplied in the sequence from the common flow path 23 to the liquid chambers 13*a* through the filter 24, the second individual flow paths 13*e* are filled with the liquid having passed through at least the filter 24. Accordingly, when the flow path width (and the height) of the second individual flow paths 13*e* are larger than the flow path width W (and the height) of the first individual flow paths 13*d*, the second individual flow paths 13*e* are not clogged with dusts and the like even if the flow path width (and the height) of the second individual flow paths 13*e* are not the same as the flow path width (and the height) of the first individual flow paths 13*d*.

Figure 9:
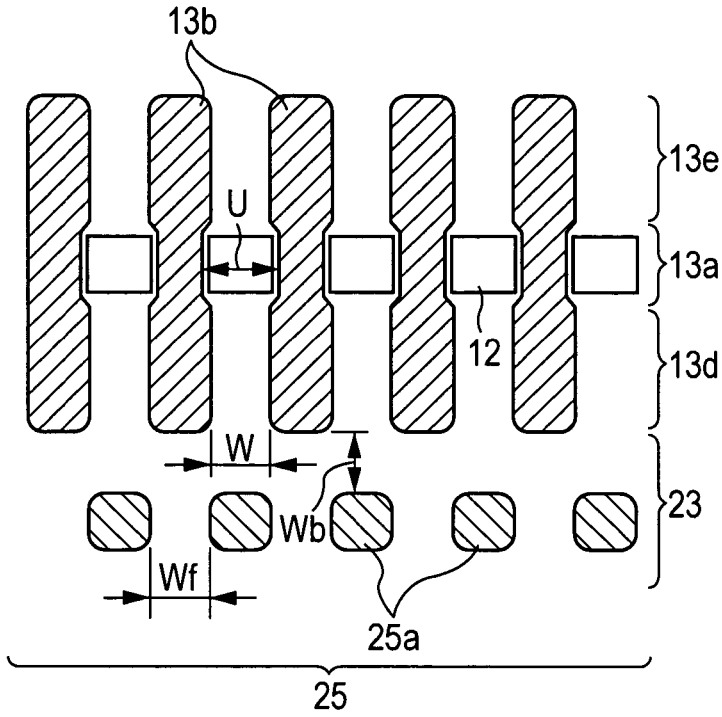
FIG. 9 is a plan view showing another embodiment of the filter.

FIG. 9 is a plan view showing another embodiment (filter 25) of the above filter. The filter 25 shown in FIG. 9 is arranged such that approximately square pillars 25*a* are disposed along the direction in which the liquid chambers 13*a* are disposed. Further, the disposing pitch of the pillars 25*a* is the same as the disposing pitch P of the liquid chamber 13*a* (this is the same in the heating elements 12 and the nozzles 18). Further, the centers of the pillars 25*a* are located on the center lines (flow path center lines) of the first individual flow paths 13*d*. Note that the lines are also the center lines of the second individual flow paths 13*e*.

Further, as shown in FIG. 9, when the distance between the end of the first individual flow path 13*d* on the column 25*a* side and the end of the column 25*a* on the first individual flow path 13*d* side is shown by wb, the distance Wb and the flow path width W of the first individual flow path 13*d* are formed to satisfy the following relation.

$$Wb \geqq W$$

It is confirmed by experiment that interference of the impact waves is eased when the liquid is ejected by formed the distance Wb and the flow path width W as described above. Note that the shape of the pillars 25*a* is not limited to the approximately square shape, and may be any shape such as a rectangular shape as shown in FIG. 7, a triangular shape, a polygonal shape including at least a pentagonal shape, a circular shape, an elliptic shape, a laterally-extended elliptic shape, and the like.

Further, even if the heating elements 12 are disposed zigzag as shown in FIG. 8, the difference of ejecting operations between the heating elements 12 near to the pillars 25*a* and the heating elements 12 far therefrom can be reduced likewise the arrangement shown in FIG. 8 by disposing the pillars 25*a* as shown in FIG. 9.

Subsequently, the relation among the open region of the nozzle 18, the flow path surface region of the first individual flow path 13*d*, and the cross sectional region of the interval between the pillars 24*a* of the filter 24 will be explained. Note that the cross sectional region of the interval between the pillars 24*a* is applicable not only to the filter 24 but also to all the filters such as the filter 25 and the like.

First, when the cross sectional region of the interval between the pillars 24*a* is compared with the flow path surface region of the first individual flow path 13*d*, the cross sectional region of the interval between the pillars 24*a* is formed in a size contained in the flow path surface region of the first individual flow path 13*d*. Further, when the flow path surface region of the first individual flow path 13*d* is compared with the opening region of the nozzle 18, the flow path surface region of the first individual flow path 13*d* is formed in a size contained in the opening region of the nozzle 18.

Figure 10:
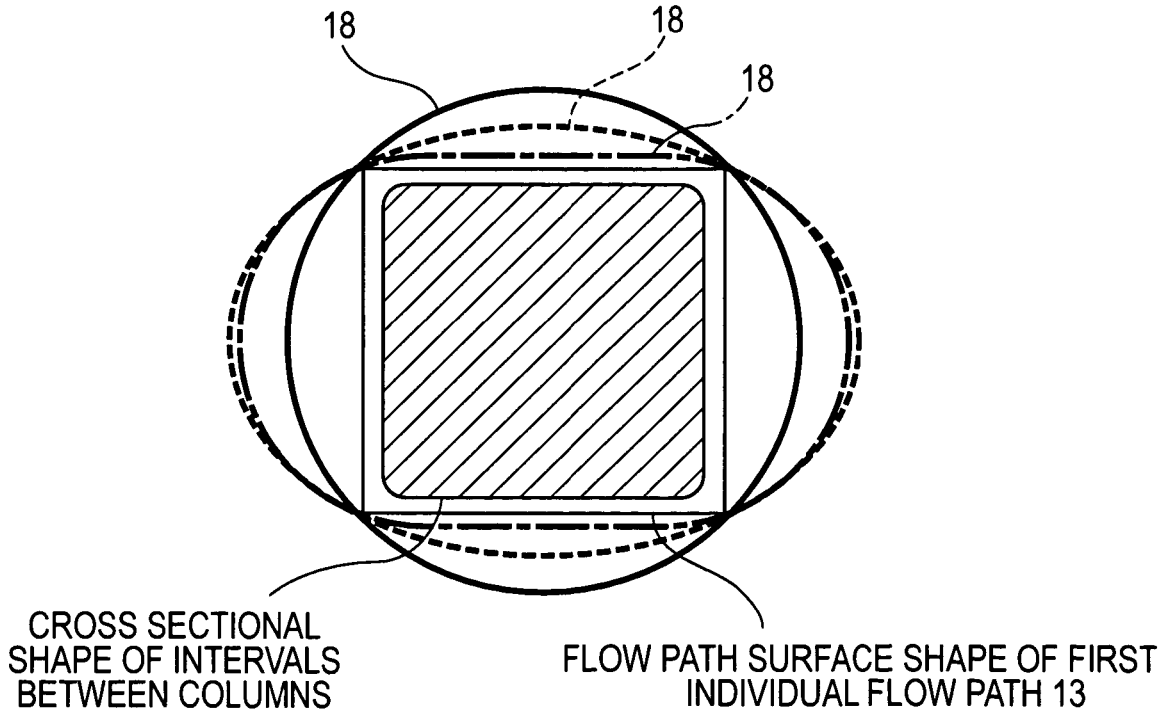
FIG. 10 is a view explaining the relation among the opening region of a nozzle, the flow path surface region of the first individual flow path, and the sectional region of the interval between the pillars of the filter.

FIG. 10 is a view explaining the above concept. Note that a reason why the nozzle 18, the first individual flow path 13*d*, and the interval between the pillars 24*a* are defined by the regions resides in that there are contemplated, as the opening shape of the nozzles 18, various shapes such as an elliptic shape (shown by a broken line in FIG. 10), a laterally-extended elliptic shape (running track shape, shown by a dot-dash-line in FIG. 10), and the like, in addition to a circular shape (shown by a solid line in FIG. 10), and there are contemplated various shapes in addition to a rectangular shape as the shapes of the cross sectional region of the interval between the column 24*a* and the flow path surface region of the first individual flow path 13*d*.

The opening shape of the nozzle 18 can be selected from a circular shape, an elliptic shape, and a laterally-linearly-extending elliptic shape, and the cross sectional shape of the interval between the first individual flow path 13*d* and the pillar 24*a* can be formed in a rectangular shape.

When the opening diameter of the ejection surface of the nozzles 18 in the direction in which they are arranged is shown by Dx and the opening diameter of the ejection surface of the nozzles 18 in a direction perpendicular to the opening diameter Dx (direction perpendicular to the direction in which the nozzles 18 are arranged) is shown by Dy, the following relation is satisfied.

$$Dx \geqq Dy$$

In this case, when the diagonal line length of the rectangular flow path surface of the first individual flow paths 13*d* is shown by L1 and the diagonal line length of the rectangular cross section of the intervals between the columns 24 is shown by L2, the nozzles 18, the first individual flow paths 13*d*, and the pillars 24*a* are formed to satisfy the following relation.

$$Dx > L1 > L2$$

When the first individual flow paths 13*d* and the pillars 24*a* are formed as described above, dusts and the like which have passed through the intervals between the pillars 24*a* of the filter 24 disposed in the common flow path 23 first can inevitably pass through the first individual flow paths 13*d* (without clogging the first individual flow path 13*d*). Further, the dusts and the like having passed through first individual flow paths 13*d* can reach the insides of the liquid chambers 13*a* due to the relation of the width U of the liquid chamber 13*a*> the flow path width W. Further, since the nozzles 18 have the maximum opening region, the dusts and the like in the liquid chambers 13*a* can be caused to pass through the nozzles 18, that is, the dusts and the like can be discharged to the outside together with the liquid when it is ejected.

Figure 11:
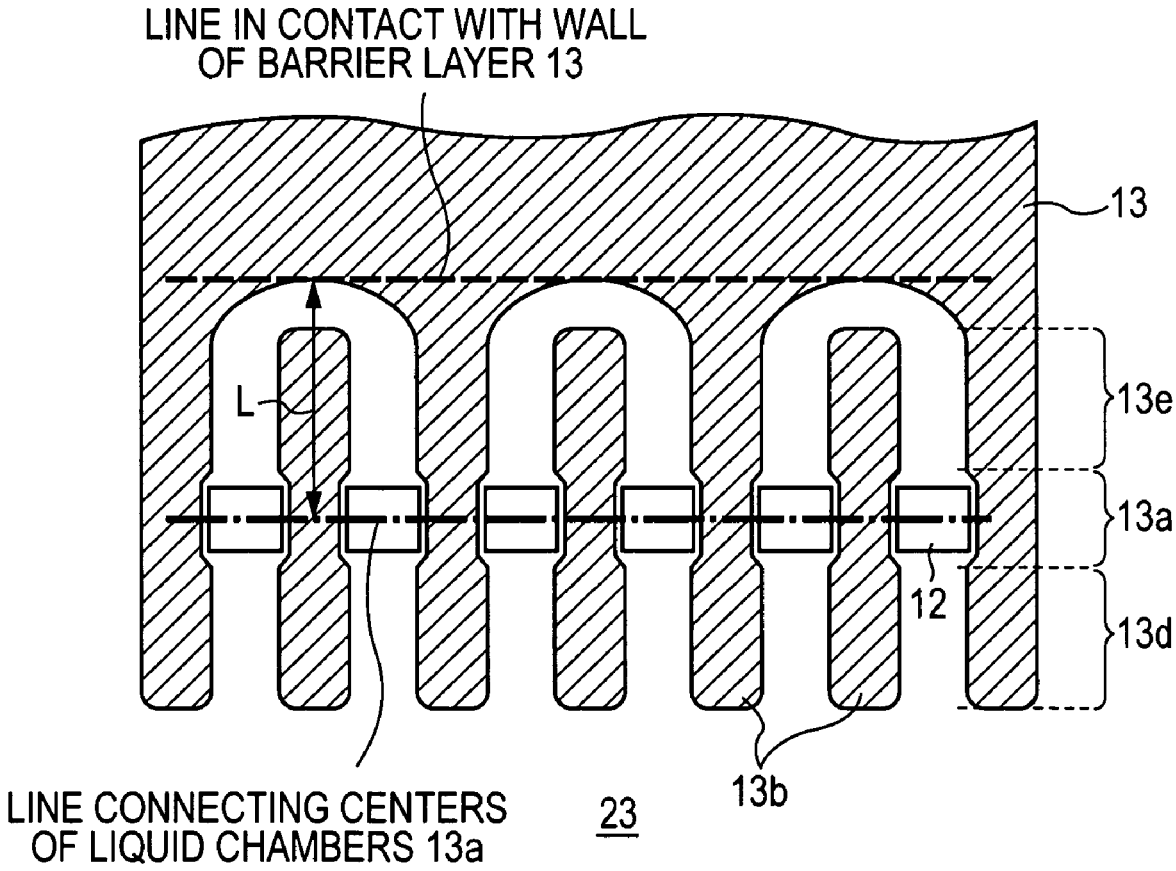
FIG. 11 is a plan view showing another embodiment of the shape of the second individual flow path.

FIG. 11 is a plan view of a second embodiment and shows the shape of the second individual flow path 13*e*. The outline of the second embodiment will be briefly described here although it is explained in detail later. As shown in FIG. 3 and the like, in the first embodiment, all the second individual flow paths 13*e* communicate with each other on the barrier layer 13 side thereof (on the side where the second individual flow paths 13*e* are located farthest from common flow path 23).

In contrast, in FIG. 11, the walls 13*b* are formed such that two adjacent second individual flow paths 13*e* communicate with each other. Note that three or more adjacent second individual flow paths 13*e* may communicate with each other, in addition to the two adjacent second individual flow paths 13*e*. This is because when at least two second individual flow paths 13*e* communicate with each other, the liquid flows from one of them to the other.

Even if the structure is arranged as shown in FIG. 11, it is formed to satisfy the various relations described above.

For example, the relation between the line, which connects the centers of the liquid chambers 13*a* in the direction of the disposing pitch P of the liquid chamber 13*a*, the line of the portion, which communicates the second individual flow paths 13*e* between adjacent liquid chamber 13*a* with each other and is in contact with the wall (barrier layer 13) located farthest from the liquid chambers 13*a*, and the disposing pitch P is set to satisfy the following relation likewise the above embodiment.

$$L \leqq 2 \times P$$

The two second individual flow path 13*e* may communicate with each other in, for example, an approximately concave shape and the like, in addition to the approximately U-shape as shown in FIG. 11.

Further, although not shown in FIG. 11, even if the above structure is employed, the filter is disposed in the common flow path 23 likewise the above embodiment.

Figure 12B:
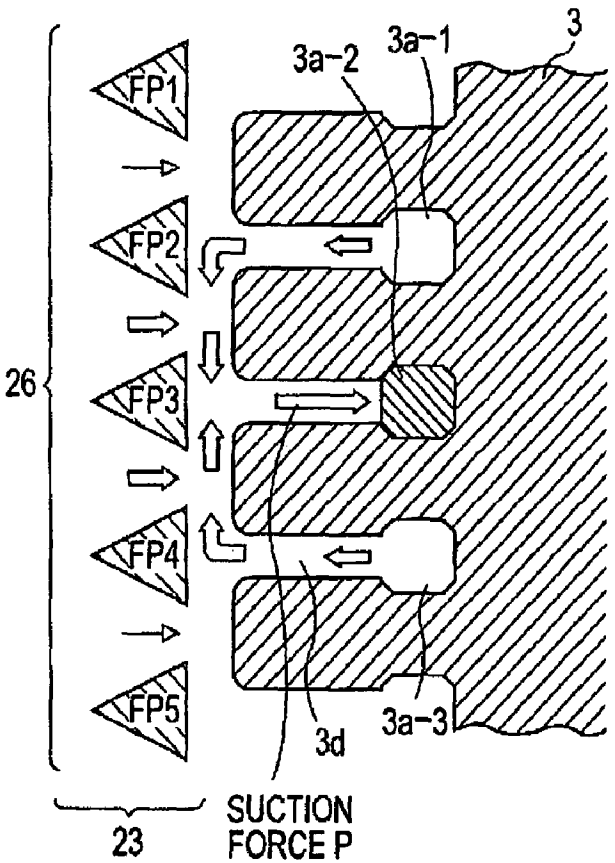
FIG. 12B (PRIOR ART)
FIG. 12B is a plan view explaining how impact waves are transmitted in an conventional structure when a liquid is ejected.
Figure 12A:
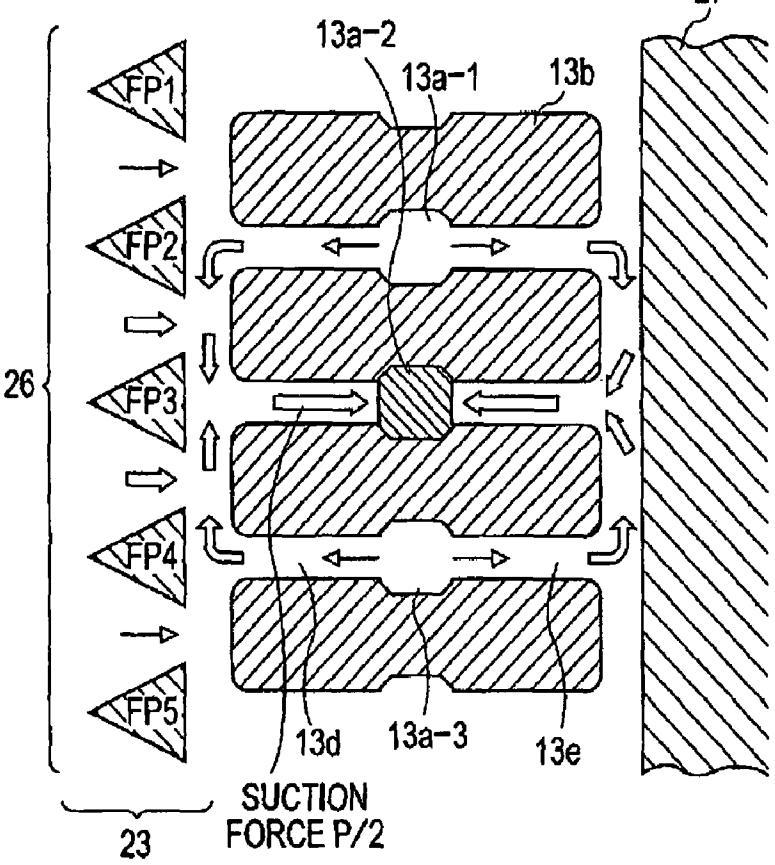
FIG. 12A is a plan view explaining how impact waves are transmitted in the embodiment when a liquid is ejected.

Subsequently, how ejection impact pressure is reduced in the structure of the embodiment will be explained. FIGS. 12A and 12B are plan views explaining how impact waves are transmitted when the liquid is ejected. To make the difference between the conventional technology and the technology of the embodiment more understandable, FIG. 12B shows a conventional structure, and FIG. 12A shows the structure of the embodiment.

Both the structures are provided with a filter 26 in which approximately triangular-prism-shaped pillars (shown by FP1 to FP5 in the figure) are disposed (the shape of the pillars are not limited to the triangular-prism-shape and may be a columnar shape and the like as described above). The pillars are disposed such that the centers thereof are in coincidence with the centers of the individual flow paths 3*d* and the first individual flow path 13*d*.

A reason why the columns are disposed as described above resides in that when impact waves of positive pressure are generated at the beginning of ejection of the liquid (in the direction in which the liquid is pushed out from the nozzles 18), an overall interference can be reduced by causing only the portions near to the liquid chambers 3*a* or the liquid chambers 13*a* to receive large impacts in the individual flow paths 3*d* and the first individual flow paths 13*d* and in the common flow path 23 connecting thereto and by minimizing the impacts spreading to the individual flow paths 3*d* and the liquid chambers 3*a* or the first individual flow paths 13*d* and the liquid chambers 13*a* other than the above.

In the conventional structure, when the liquid is ejected from a liquid chamber 3*a*-2, first, the liquid is expanded due to bubbles generated to eject the liquid and the liquid is pushed out by a large amount of positive pressure generated subsequently. However, negative pressure is generated in the liquid chamber 3*a*-2 because the bubbles are contracted just after the liquid is ejected, thereby suction force (P in the figure) acts on the liquid existing in the individual flow paths 3*d* in a direction in which the liquid is sucked into the liquid chamber 3*a*-2. In particular, in the conventional structure, the liquid corresponding to the amount of liquid lost in (ejected from) one individual flow path 3*d* is sucked. However, the liquid cannot move instantly because it is arranged continuously, and mass, viscosity resistance, and the like act on the liquid. Accordingly, first, impact waves spread.

Although the impact waves damp as they spread farther, they are also transmitted to the outside of the filter 26 and to liquid chambers 3*a*-1 and 3*a*-3 on both the sides of the liquid chamber 3*a*-2 through the liquid.

When the impact waves are transmitted to any liquid chamber 3*a*, the meniscuses of respective nozzles 18 are fluctuated. It is contemplated that when the liquid is ejected from the liquid chamber 3*a* at the time vibrations reaches it (when the meniscuses are fluctuated), interference occurs and the liquid is ejected unevenly.

In contrast, in the embodiment, when the liquid is ejected from, for example, a liquid chamber 13*a*-2, since impact waves spread in both the right and left directions, that is, spread to both the first individual flow paths 13*d* and the second individual flow paths 13*e*, energy is divided to one-half and spreads in the respective directions. More specifically, in the conventional structure, since only the individual flow path 3*d* side is opened, the energy spreading to the side opposite to the individual flow paths 3*d* is reflected on the wall at once and combined with an energy component spreading outward from the individual flow paths 3*d*. In contrast, in the structure of the embodiment, each one-half of the energy is radiated in opposite directions.

Further, in the embodiment, since suction force is generated in both the first individual flow paths 13*d* and the second individual flow paths 13*e*, the magnitude of the suction force generated in the respective individual flow paths is reduced to P/2. Accordingly, the influence of the impact waves can be reduced one-half.

In the embodiment, the filter 26 is disposed to the outlets of the first individual flow path 13*d* (in the common flow path 23) as well as a wall 27 is disposed to the outlets of the second individual flow paths 13*e*. With this arrangement, the impact waves can be converged in a range as small as possible.

Figure 13B:
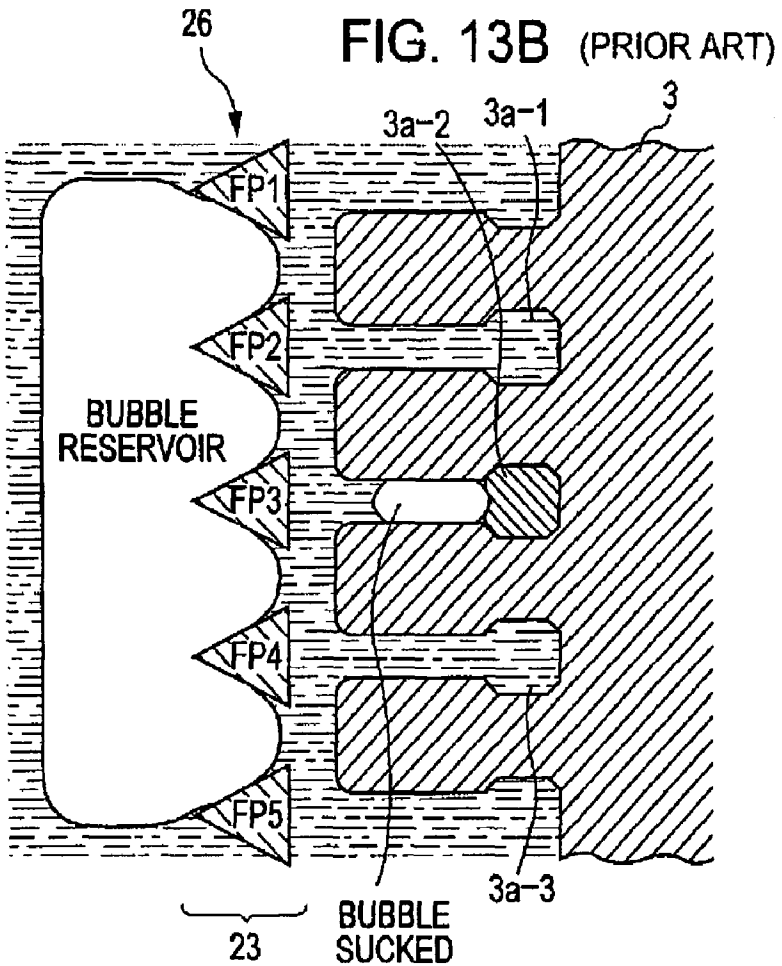
FIG. 13B (PRIOR ART)
FIG. 13B is a plan view showing how bubbles are generated in a conventional structure.
Figure 13A:
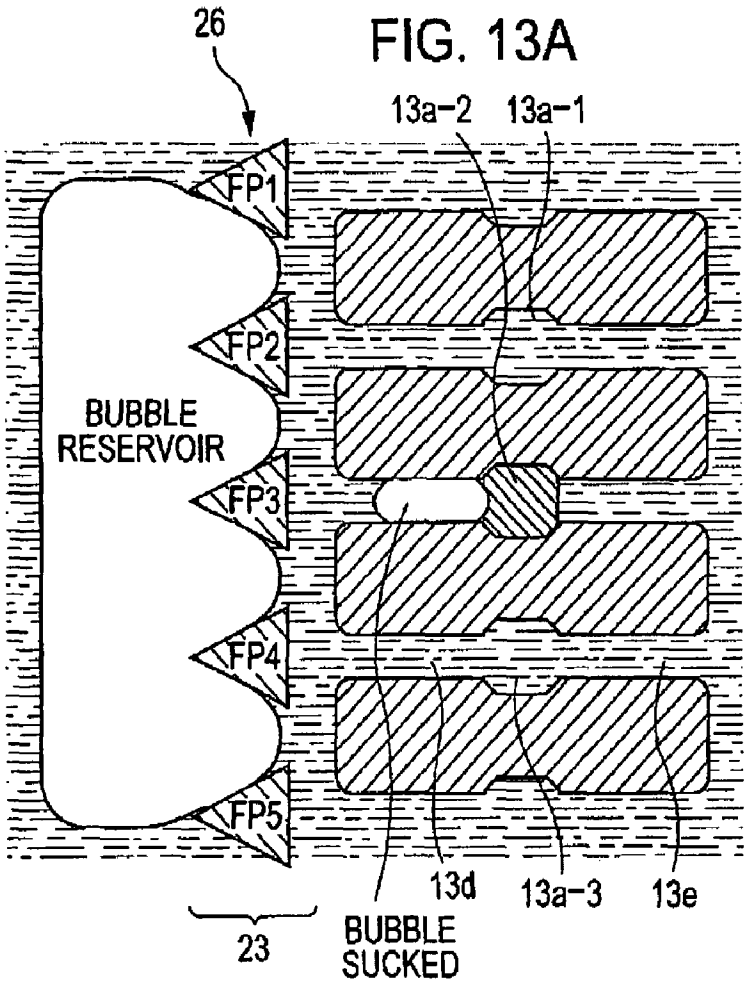
FIG. 13A is a plan view showing how bubbles are generated in the structure of the embodiment.

Next, the influence of bubbles in the embodiment will be explained. FIGS. 13A and 13B are plan views showing how bubbles are generated. In the figure, FIG. 12B shows a conventional structure, and FIG. 12A shows the structure of the embodiment to make the difference between the conventional technology and the technology of the embodiment more understandable also in FIGS. 13A and 13B.

When the liquid is ejected many times per unit area and further high density images and the like are continuously recorded, the head is excessively heated and bubbles are liable to be generated in a portion in contact with the liquid. The thus generated bubbles are combined with each other and grown to relatively large bubbles. Under the above circumstances, the bubbles may approach the filter 26 side and adhered thereto (FIG. 13).

When the grown bubbles approach the filter 26, if the liquid is not ejected frequently in the vicinity of the filter 26 and the amount of movement of the liquid is such that the liquid supplied from a portion slightly apart from the filter 26 is sufficiently used for refilling, the bubbles are only in contact with the vicinity of the filter 26 (the left corner portions of the pillars of the filter 26 in the filter). However, when the liquid is ejected frequently and the movement of the liquid cannot follow the frequent ejection, the liquid pressure (water pressure) in the vicinity of the filter 26 is reduced, thereby the bubbles adhered to the filter 26 are sucked to the vicinity of the outlet of the filter 26 (right side in the figure). FIGS. 13A and 13B show bubbles in the above state.

Figure 22:
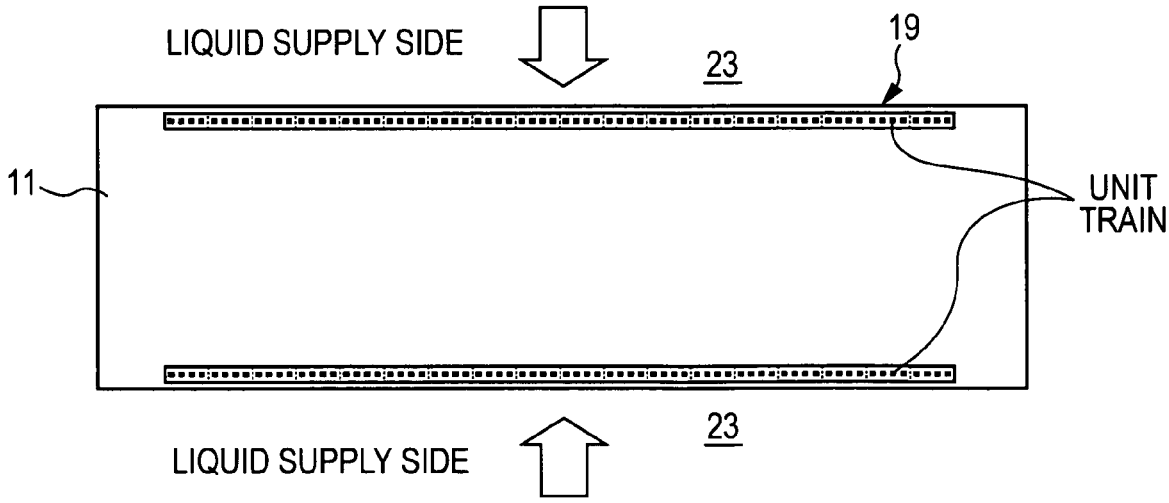
FIG. 22 is a plan view showing another example of the head chip.

When the above state further continues, bubbles fly from between the pillars of the filter 26 and sucked into the individual flow paths 3*d* or the first individual flow paths 13*d*, or the meniscuses of the nozzles 18 are broken, and gases (bubbles) are sucked from the nozzles 18 as shown in FIG. 22. It has been confirmed that the impact waves described above act as a trigger at the time.

When the bubbles are sucked into the individual flow paths 3*d* in the conventional structure (refer to FIG. 13B), if the bubbles have such a small size that they do not block the flow path surfaces (cross sections) of the individual flow paths 3*d*, they are discharged to the outside from the nozzles 18 while the liquid is ejected repeatedly. In contrast, if the bubbles have such a large size that they block the individual flow paths 3*d*, they separate the liquid chambers 3*a* from the common flow path 23.

When the bubbles exist in the liquid chambers 3*a*, the liquid cannot reach the nozzles 18. This is because inside pressure is lower than the atmospheric pressure. When energy is applied to the heating elements 12 which are not covered with the liquid, the slightly remaining liquid is exhausted at once and thereafter the state in which a heating operation is executed without liquid occurs. Accordingly, an ejection failure, for example, recovery is impossible, and the like occurs unless a special cleaning operation is executed. Further, kogation is accelerated.

In a head employing a serial system capable of executing overlapped writing, it is possible to recover images and the like printed in failure so that they are made inconspicuous even if there exist about one or two pieces of ejection failed nozzles 18. In contrast, in a line head system, even if one piece of failed nozzle 18 exists, the failed nozzle 18 is reflected on image quality as it is because the overlapped writing cannot be executed.

Accordingly, in the liquid ejection device employing the thermal system, countermeasures must be taken to prevent occurrence of the above problem. In the conventional structure, as one of the countermeasures, circumstances in which bubbles are generated in the liquid are avoided as much as possible by lowering the heat release value of the liquid ejection head itself or enhancing a radiation effect. As a specific countermeasure, an ejection cycle is suppressed to a certain level or less. With this countermeasure, the heat release value can be reduced. Further, it is also possible to lower an ejection cycle to prevent the inside pressure from reaching such a degree as to cause bubbles to enter the individual flow paths 3*d*. However, in the conventional structure, since the ejection cycle must be lowered as described above to solve the above problem, the countermeasure is not suitable for a high speed print and thus is not appropriate to the line head system having a feature in the high speed print.

In contrast, FIG. 13A shows the state in which bubbles are sucked into the first individual flow paths 13*d* in the structure of the embodiment. Since the nozzles 18 are dominated by the liquid in both the first individual flow paths 13*d* and the second individual flow paths 13*e*, even if bubbles intend to enter a liquid chamber 13*a*-2 from the first individual flow path 13*d* side, an equilibrium is kept in this state unless the liquid is ejected or the bubbles disappear.

When the liquid is continuously ejected in this state, impact waves are applied to both the first individual flow paths 13*d* and the second individual flow paths 13*e*. However, since the first individual flow path 13*d* side is clogged with the bubbles, the bubbles are sucked and reach the liquid chamber 13*a*-2. Then, the walls of the liquid existing among the liquid chamber 13*a*-2 and the nozzles 18 are broken, thereby the bubbles are discharged to the outside. Although the bubbles are discharged by the ejection executed once or several times in this case, the liquid chamber 13*a*-2 continuously acts as a pump during the ejection, and the liquid is replenished from the second individual flow path 13*e* side (that is, the liquid achieves a pump-priming role.

Accordingly, in the structure of the embodiment, even if one individual flow paths (the first individual flow path 13*d* in this example) are clogged with bubbles, the liquid is continuously supplied to the liquid chambers 13*a* as long as the other individual flow paths (the second individual flow paths 13*e* in this example) are filled with the liquid, thereby the bubbles are discharged to the outside, and a normal state can be recovered. Accordingly, a self-cleaning effect to bubbles can be provided and a possibility that an heating operation is executed by the heating elements 12 without liquid can be greatly reduced, thereby a possibility that an ejection failure occurs can be almost eliminated. As a result, in the structure of the embodiment, the countermeasure necessary to the conventional structure need not be taken, and thus the ejection cycle need not be lowered.

Note that since the liquid, which fills the second individual flow path 13*e*, is the liquid having passed through the filter 26, the second individual flow paths 13*e* are not almost clogged with dusts and the like. Further, since the second individual flow path 13*e* side has no portion acting as a resistance such as the filter 26 when the liquid moves, even if some bubbles exist, they do not block the movement of the liquid. It is contemplated from what is described above that it never occurs that the liquid cannot be replenished from the second individual flow paths 13*e* into the liquid chambers 13*a*.

Subsequently, examples of the present invention will be explained.

EXAMPLE 1

Figure 14A:
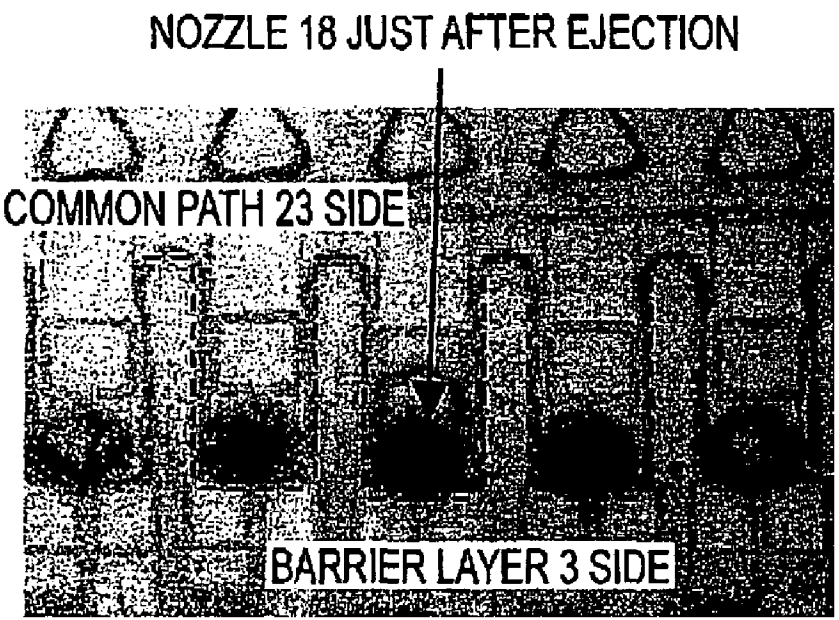
FIG. 14A is a view showing that a reduction in impact waves is confirmed (as a result of photographing) in the structure of the embodiment.
Figure 14B:
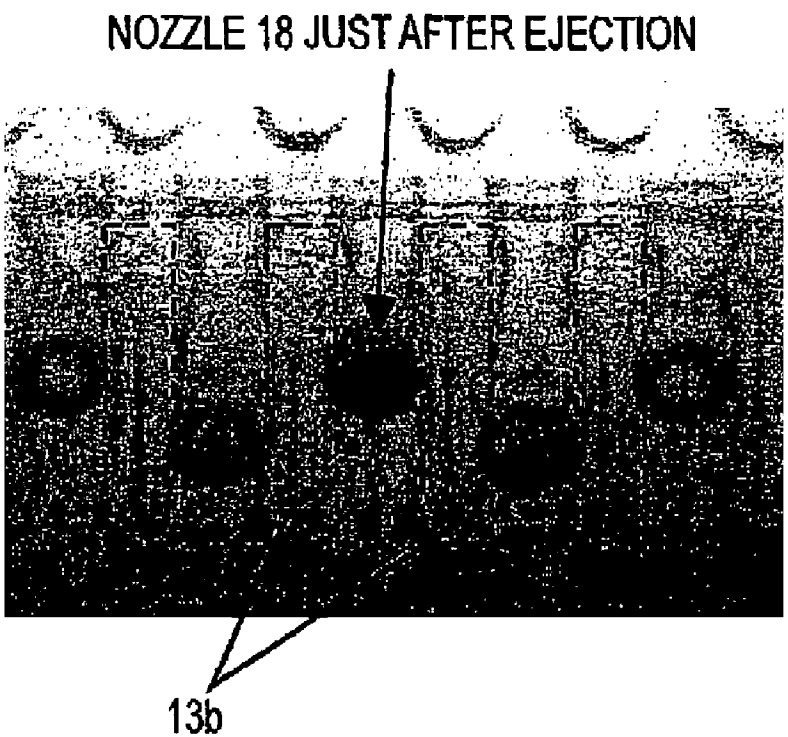
FIG. 14B (PRIOR ART)
FIG. 14B is a view showing that a reduction in impact waves is confirmed (as a result of photographing) in the conventional structure.

FIGS. 14A and 14B are views showing a result that a reduction in impact waves is confirmed (as a result of photographing) in the conventional structure and in the structure of the embodiment.

In an example 1, a semiconductor substrate 11, on which 320 heating elements 12 are disposed at 600 DPI (nozzle intervals are set to 4.2 μm), is used (size: about 16 mm×16 mm).

A nozzle sheet 17 composed of a transparent acrylic resin is used so that an internal behavior can be observed. The result of experiment shown in FIGS. 14A and 14B corresponds to the view shown in FIG. 12.

In the conventional structure of FIG. 14B, nozzles 18 arranged linearly. In contrast, in the example, nozzles 18 are arranged zigzag as described above.

In FIGS. 14A and 14B, the nozzles 18 seem black just after they eject the liquid because a liquid surface is intensely fluctuated by the influence of impact waves. Although the longitudinal lines of the heating elements 12 disposed below are not almost observed in the conventional structure (the heating elements 12 are vertically separated to one-half), they are relatively observed in the structure of the example. Further, it can be found that although adjacent nozzles 18 also seem black by the influence of the impact waves in the conventional structure, adjacent nozzles 18 in the structure of the example seem less black.

EXAMPLE 2

Figure 15:
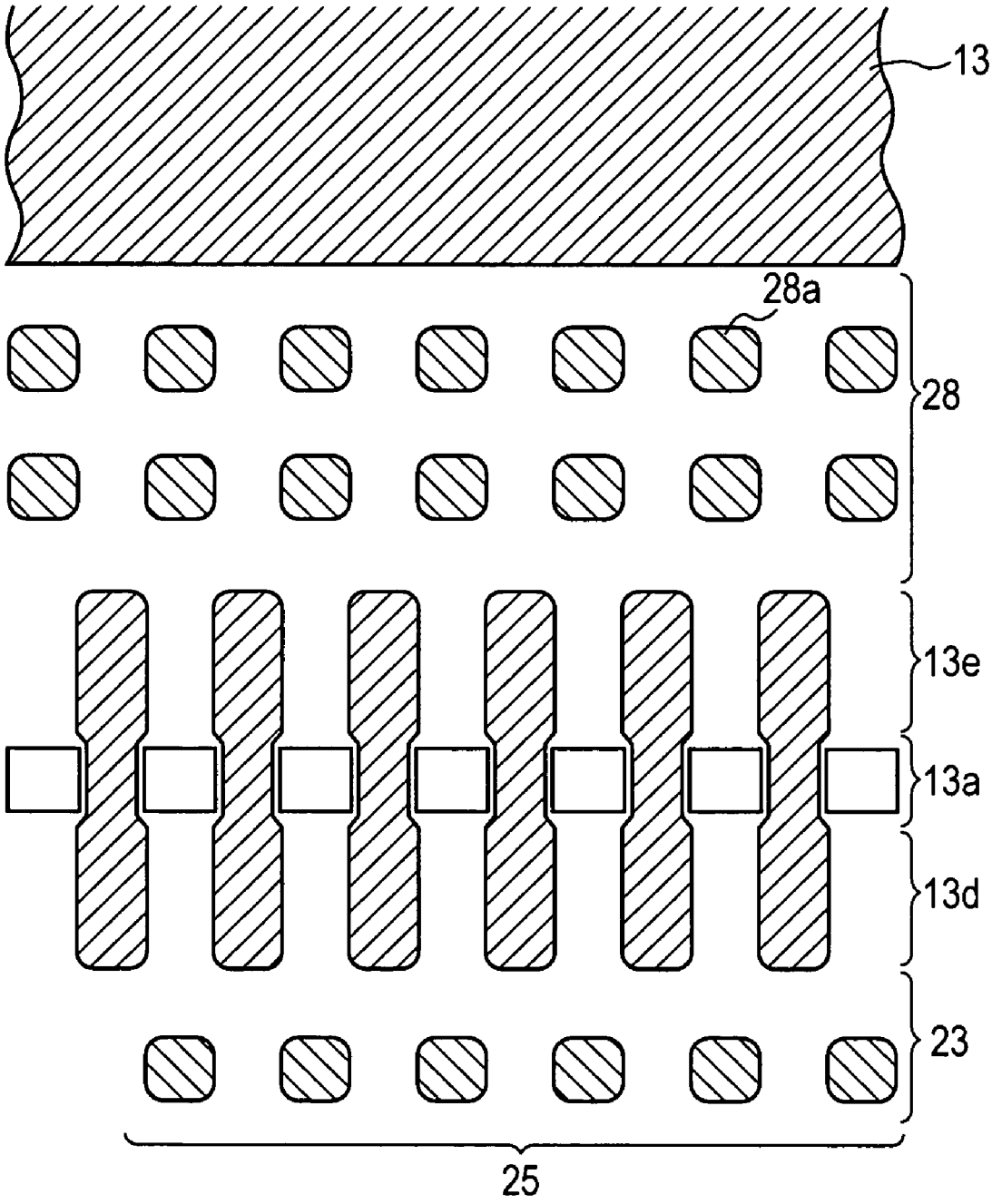
FIG. 15 is a plan view showing a specific structure of a head used in an example 2.

FIG. 15 is a plan view showing a specific structure of a head used in an example 2. As shown in FIG. 15, the head used in the example 2 is provided with a liquid storage region 28 having pillars 28*a* interposed between the outlets of the second individual flow paths 13*e* and the wall of the barrier layer 13. A filter 25 disposed in a common flow path 23 is the same as the filter 25 shown in FIG. 9.

Figure 16:
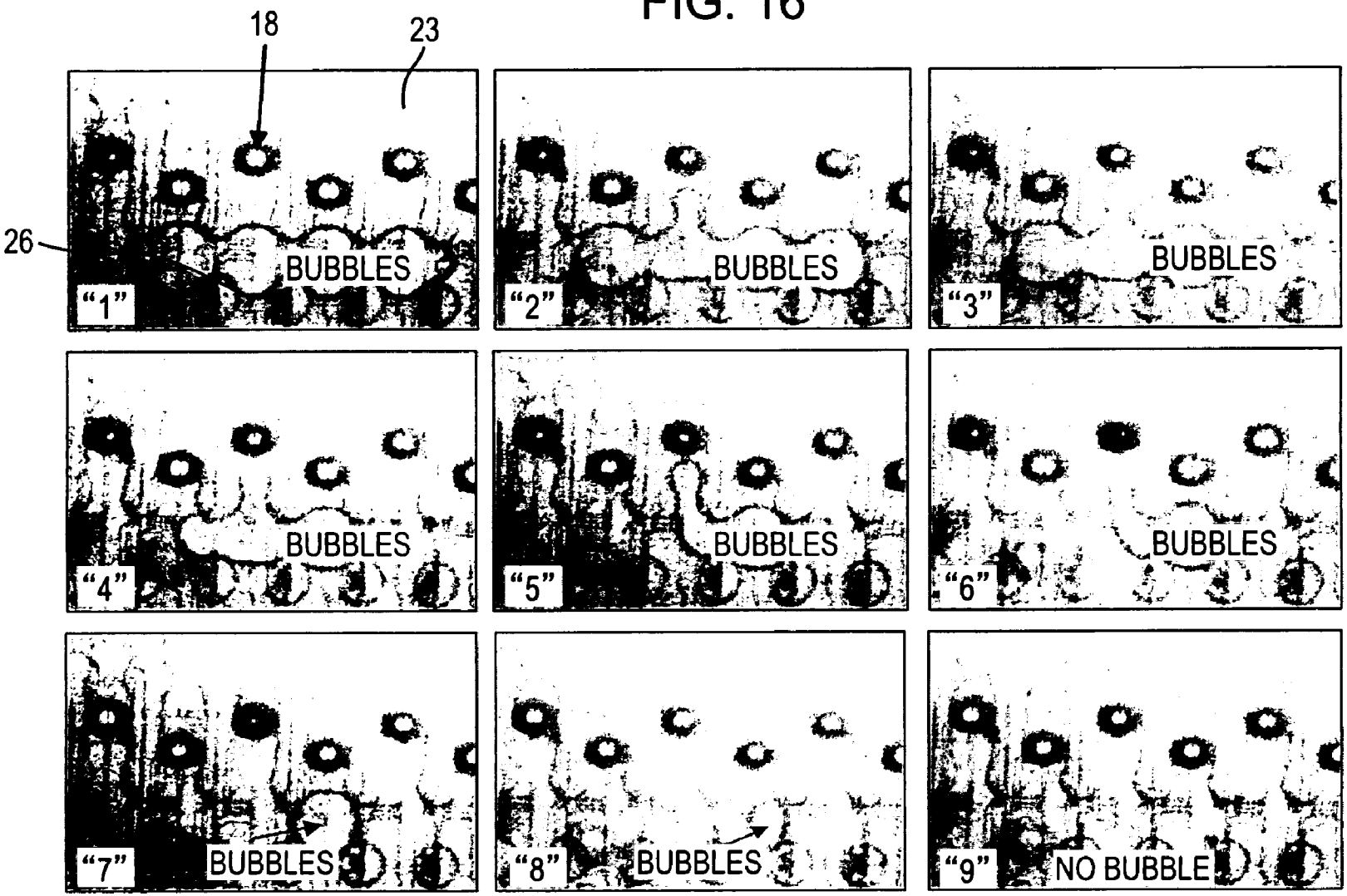
FIG. 16 shows photographs taken sequentially to illustrate how bubbles are discharged using a head having the structure shown in FIG. 15.

FIG. 16 is a view showing how bubbles are discharged using a head having the structure shown in FIG. 15 as a result sequential photographing. FIG. 16 shows the behavior of bubbles discharged in the sequence of "1", "2" . . . "9".

In "1" of FIG. 16, bubbles were injected from the nozzles, and the space between the liquid storage region 28 and the second individual flow paths 13*e* was clogged with the bubbles. Then, when a liquid ejecting operation was repeated using a third nozzle 18 from the left side as shown in "1", the bubbles were gradually discharged from the nozzle 18.

EXAMPLE 3

Figure 17B:
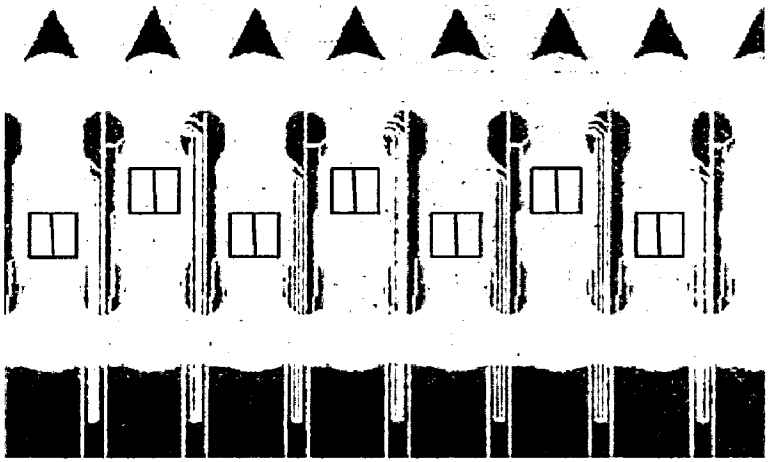
FIGS. 17A and 17B are views showing a part of a mask view of a prototype head.
Figure 17A:
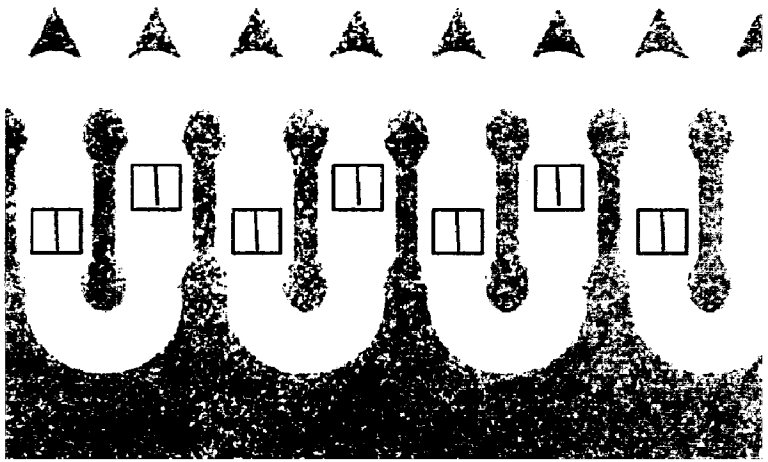

FIGS. 17A and 17B are views showing a part of a mask view of a prototype head (nozzle pitch: 42.3 μm, resolution: 600 DPI). In FIGS. 17A and 17B, an upper side is a common flow path 23 side.

FIG. 17A shows an example corresponding to the arrangement shown in FIG. 11 (the second embodiment described later in detail), FIG. 17B shows an example corresponding to the arrangement shown in FIG. 3.

That is, In FIG. 17A, adjacent second individual flow paths 13*e* communicate with each other. Further, FIG. 17B, all the second individual flow paths 13*e* communicate with each other.

Further, the filter 25 is composed of triangular-prism-shaped pillars. Further, the heating elements are arranged zigzag.

When images were actually printed with the heads, burst errors (wide portions with uneven color and voided portions in monochrome), which were liable to appear in the conventional structure when a temperature increased in continuous printing or when print was executed first at a low temperature, were almost eliminated in any of the heads. Since a semiconductor substrate 11, heating elements 12, and the like were the same as those used in the conventional structure and only a flow path structure was different from that of the conventional structure, the effect of the flow path structure of the present invention could be confirmed.

The second embodiment described above will be explained below in detail.

The inventors of the present invention have developed a technology for deflecting ejection of liquid droplets disclosed in Japanese Unexamined Patent Application Publication No. 2004-001364. It is found that an ejection speed is lowered by executing the deflecting ejection. This is because since a plurality of heating elements are disposed in one liquid chamber and generate bubbles at different timing, ejection pressure is lower than an ordinary system in which bubbles are generated on only one heating element.

In contrast, it is found that an ejection speed in the first embodiment of the present invention is somewhat lower than a conventional ejection speed (lowered to about 7-8 m/sec from conventional 10 m/sec).

When the ejection speed is lowered as described above, there is a possibility that the density of an printed image is made uneven although the liquid is not ejected unevenly.

Further, when the ejection speed is lowered, the amount of the liquid remaining on a nozzle sheet is increased depending on the wetting state of the peripheries of orifices because the liquid is attracted by the surface tension of remaining droplets.

In particular, a period of time during which print is continuously executed without cleaning an ejecting surface is longer in a line head than a serial head, and thus a larger amount of print is executed in the line head. Accordingly, the amount of liquid remaining in the vicinities of the orifices is increased and interferes with liquid droplets to be ejected new.

Accordingly, in the second embodiment of the present invention, the uneven density is improved by preventing the reduction of the ejection speed of droplets by improving the first embodiment.

A second embodiment of the present invention is a liquid ejection device which includes a plurality of heating elements disposed on a semiconductor substrate along one direction, a nozzle layer through which nozzles located on the heating elements are formed, a barrier layer interposed between the semiconductor substrate and the nozzle layer, partition walls formed of a part of the barrier layer and interposed between the heating elements as well as extending in a direction perpendicular to the direction in which the heating elements are arranged and permitting a liquid to flow to the heating elements side from both the sides thereof of a direction perpendicular to the direction in which the heating elements are arranged, a pair of side walls formed of a part of the barrier layer and disposed to N (N is an integer of at least 2) pieces of heating elements and (N−1) pieces of partition walls externally thereof in parallel with the partition walls, and a rear wall formed of a part of the barrier layer and disposed in the direction in which the heating elements are arranged. In the liquid ejection head, when the interval between the partition walls and the rear wall is shown by x, and the interval between the side walls and the rear wall is shown by y, the intervals x and y satisfy the following condition.

$$0 \leqq y < x$$

Further, a liquid ejection unit includes the N pieces of heating elements, the (N−1) pieces of partition walls, a pair of the side walls, and the rear wall, a common flow path is disposed to the heating elements on a side opposite to the rear wall, and a liquid is supplied to the heating elements side of the liquid ejection unit from the common flow path side and from a side opposite to the common flow path side.

In the second embodiment, a liquid ejection unit, which includes N heating elements, (N−1) partition walls, right and left side walls, and a rear wall, are provided, and the liquid can flow into the heating elements from both the sides by the partition walls and the like. Further, in the structure of the second embodiment, the liquid can be supplied to the heating elements from both the sides. However, the pressure on the heating elements (in the liquid chambers) is liable to be dropped by the provision of the pump-priming function. However, since the liquid ejection unit has the closed structure as a single unit, the pressure drop is eliminated and pressure necessary to eject the liquid can be maintained when the value of N is appropriately selected.

Although a nozzle layer and a barrier layer are provided as separate members (barrier layer 13 and nozzle sheet 17) in the following embodiment, they may be formed integrally with each other likewise the first embodiment. Otherwise, the barrier layer may be formed on the semiconductor substrate integrally therewith. In the following description, the same portions as those of the first embodiment are denoted by the same reference numerals, and the explanation thereof is omitted.

According to the second embodiment, occurrence of uneven density can be reduced by securing the ejection speed (pressure) of liquid droplets which is liable to be reduced. Further, the amount of liquid remaining on the nozzle sheet can be reduced. Furthermore, even if the technology of the deflecting ejection described above is employed, an excellent ejecting operation can be secured.

The second embodiment will be further explained with reference to the figures and the like.

Since the arrangement of a printer main body to which the second embodiment is applied, the outside appearance of a line head 10, the arrangement of head chips 19 are the same as those of the first embodiment, the explanation thereof is omitted. The structure of the head chip 19, which is typical to the second embodiment, will be explained below.

The head chip 19 of the second embodiment is arranged such that heating elements 12 are disposed on a semiconductor substrate 11 likewise the first embodiment when compared with the conventional head chip 1*a*. However, the shape of a barrier layer 13 disposed on the semiconductor substrate 11 is different from that of the conventional head chip 1*a*. A reason why the shape of the barrier layer 13 is different resides in that the shape of the peripheries of the heating elements 12 (partition walls 33*a* described later) and the shape from a common flow path 23 to the heating elements 12 are different.

Figure 18:
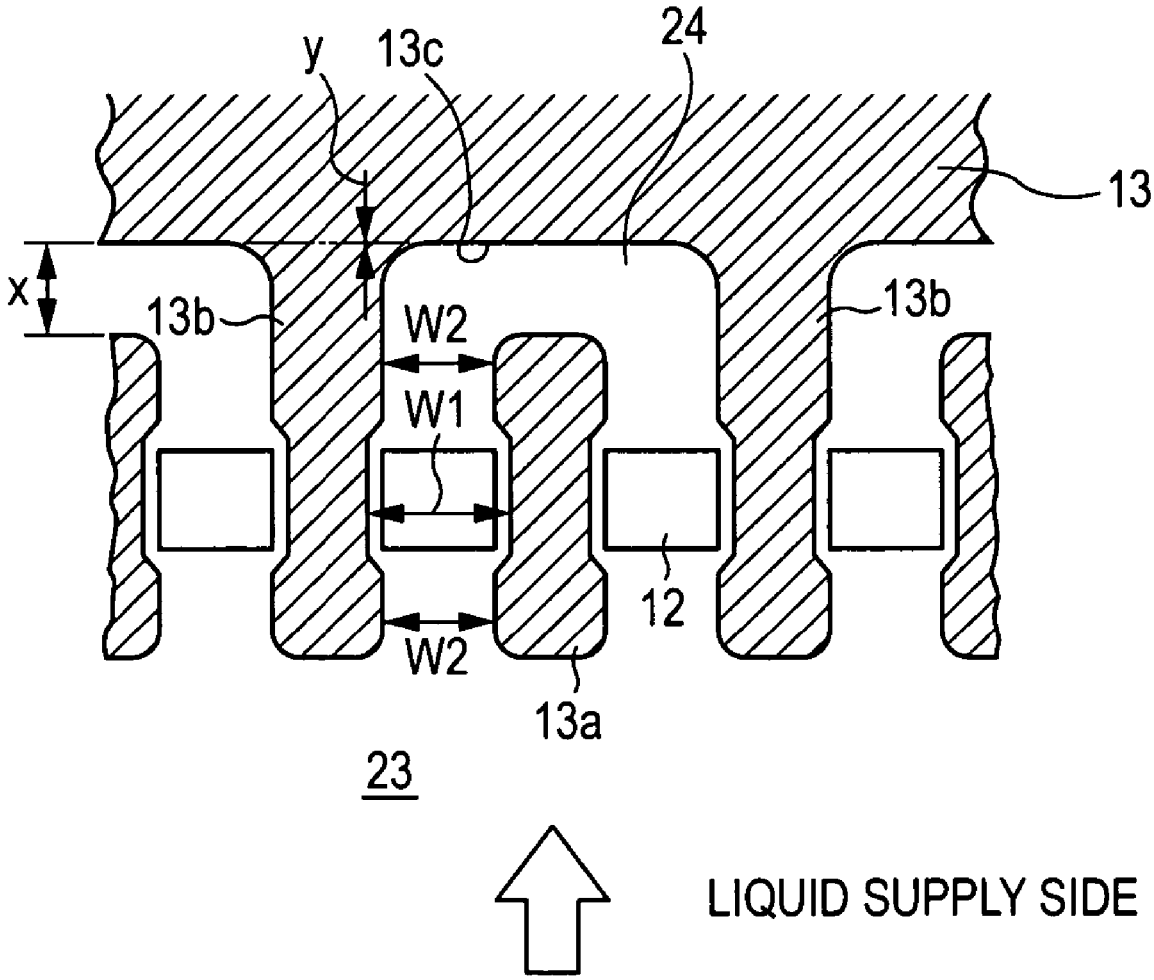
FIG. 18 is a plan view showing the shape of a barrier layer of a head chip as a second embodiment of the present invention.

FIG. 18 is a plan view showing the shape of the barrier layer 13 of the head chip 19 as the second embodiment of the present invention.

The heating elements 12 are disposed on the semiconductor substrate likewise those in the conventional technology. In FIG. 18, the partition walls 33*a* are interposed between the heating elements 12. The partition walls 33*a* are formed of a part of the barrier layer 33 and disposed to extend in a direction perpendicular to the direction in which the heating elements 12 are arranged. The thickness of both the ends of each of the partition walls 33*a* in a lengthwise direction is formed thicker than the central portion thereof. With this arrangement, the interval W1 between the partition walls 33*a* in the region (which is called a "liquid chamber") on the heating element 12 and the interval W2 between both the ends of the partition walls 33*a* are formed to satisfy the following relation.

$$W1>W2$$

With this arrangement, the portion in the interval W2 is provided with a function as a filter for eliminating dusts and the like as well as can increase internal pressure (in the liquid chambers) when liquid droplets are ejected.

There are provided pairs of side walls 33*b* on both the sides of N pieces of heating elements 12 and (N−1) pieces of partition walls 33*a*. In the example shown in FIG. 18, N=2 (two heating elements 12, and one partition walls 33*a* interposed between the two heating elements 12). The side walls 33*b* are formed of a part of the barrier layer 33 and disposed approximately in parallel with the partition walls 33*a* as well as the shape of the side walls 33*b* on the common flow path 23 side is approximately the same as the partition walls 33*a*. Further, flow paths traveling from the common flow path 23 to the heating elements 12 are formed by the side walls 33*b* and the partition walls 33*a*.

Rear wall 33*c* is formed of a part of the barrier layer 33 on a side opposite to the common flow path 23. The rear wall 33*c* is formed along the direction in which the heating elements 12 are disposed.

In this case, the partition walls 33*a* are spaced apart from the rear wall 33*c* at an interval x. With this arrangement, rear common flow paths 34 are formed on the rear wall 33*c* side, and the liquid can be moved on the two heating elements 12 separated by the partition wall 33*a* through the rear common flow path 34.

Further, the side walls 33*b* are coupled with the rear wall 33*c* (in the example shown in FIG. 18). With this arrangement, the liquid cannot move between the heating element 12, which is disposed externally of the side wall 33*b* (heating element 12 on the right or left side in FIG. 18), and the two heating elements 12, which are disposed internally of the side walls 33*b*, on the rear common flow path 34 side.

With the above arrangement, the liquid can move through the rear common flow path 34 on the rear wall 33*c* side only in the inside portion whose outside is surrounded by the side walls 33*b*. In the embodiment shown in FIG. 18, although the liquid can move between the two heating elements 12 (liquid chambers), an increase in the number of the heating elements 12 in the pair of side walls 33*b* permits the liquid to move on the increased number of heating elements 12.

When the rear wall 33*c* is coupled with the side walls 33*b*, y=0 where the interval between the ends of the side walls 33*b* on the rear wall 33*c* side and the rear wall 33*c* is shown by y.

$$y=0$$

In the present invention, however, it is sufficient that the interval y is less than the interval x, and the interval y may be larger than 0, that is, an interval may be formed between the ends of the side walls 33*b* on the rear wall 33*c* side and the rear wall 33*c*.

Accordingly, it is sufficient to set the value of y to satisfy the following condition.

$$0 \leqq y < x$$

When the interval is formed as described above, the liquid can move at least through the rear common flow path 34 on the rear wall 33*c* side between the heating elements 12 separated only by the partition wall 33*a*. Further, even if an interval exists between the side walls 33*b* and the rear wall 33*c*, a considerable amount of resistance is accompanied with the liquid when it is moved to a next heating element 12 through the interval.

Here, the portion, which includes the N pieces of heating elements 12, the (N−1) pieces of partition walls 33*a*, the pairs of side walls 33*b*, and the rear wall 33*c*, is called the "liquid ejection unit". In the embodiment, the liquid ejection units are disposed in parallel with each other on the semiconductor substrate.

Figure 19:
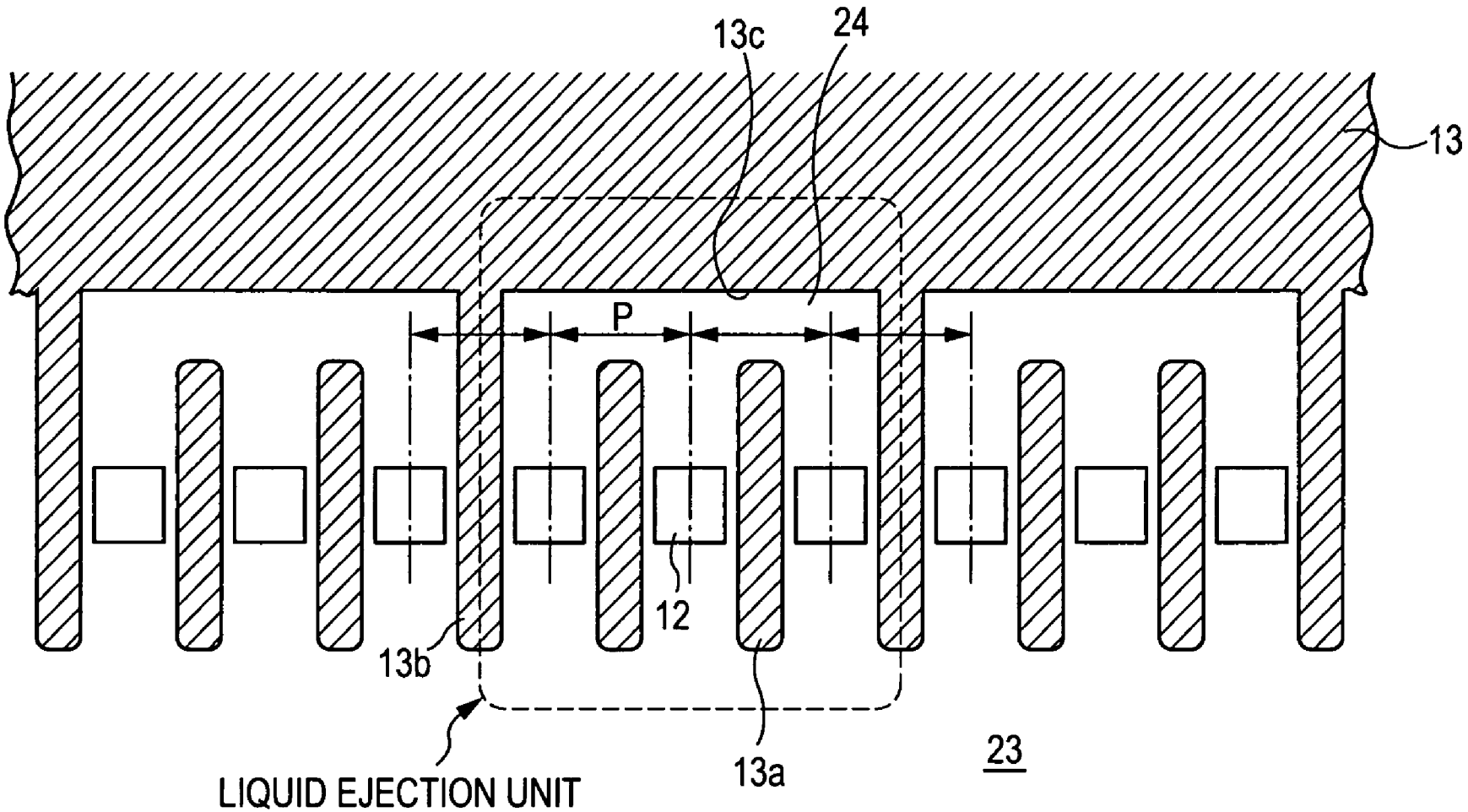
FIG. 19 is a plan view showing the shape of a barrier layer of a head chip as a third embodiment of the present invention.

FIG. 19 is a plan view of a third embodiment and shows the shape of a barrier layer 33 of a head chip 19.

In the embodiment shown in FIG. 19, N=3. That is, a liquid ejection unit is composed of three heating elements 12, two partition walls 33*a*, one side wall 33*b* disposed on both the sides of the partition walls 33*a*, and a rear wall 33*c*. Further, in the embodiment shown in FIG. 19, the extreme ends of the partition walls 33*a* and the side walls 33*b* are not made thick different from the embodiment shown in FIG. 18. When the partition walls 33*a* and the side walls 33*b* are formed as described above, although the extreme ends thereof cannot be provided with a function as a filter, no particular problem arises when a filter and the like are separately disposed on a common flow path 23 side.

When the embodiment is formed as shown in FIG. 19, the liquid can be moved on the three heating elements 12 from a rear common flow path 34 side in the one liquid ejection unit. However, the liquid cannot be further moved onto a heating element 12 externally of the three heating elements 12 due to the existence of the side walls 33*b*.

As shown in FIG. 19, a plurality of the liquid ejection units are disposed in parallel with each other on a semiconductor substrate such that the heating elements 12 have the same pitch (disposing pitch) P between adjacent liquid ejection units. Note that not only a pair of side walls 33*b* are independently disposed to each liquid ejection unit between adjacent liquid ejection units but also one side wall 33*b* is commonly used between the adjacent liquid ejection units. Then, one liquid ejection unit is formed continuously to an adjacent liquid ejection unit by being formed integrally therewith.

Further, although N=3 in FIG. 19, N=2 is also applicable as shown in FIG. 18. That is, it is sufficient that N satisfies the following condition.

$$N>2$$

In contrast, the value of N is excessively large, the open portion in one liquid ejection unit is increased, thereby the ejection speed (ejection pressure) of liquid droplets is reduced and uneven ejection is caused accordingly. It can be found from a result of experiment that a good result can be obtained in the range of N≦8.

Therefore, the value of N is set as follows.

$$2 \leqq N \leqq 8$$

Figure 20:
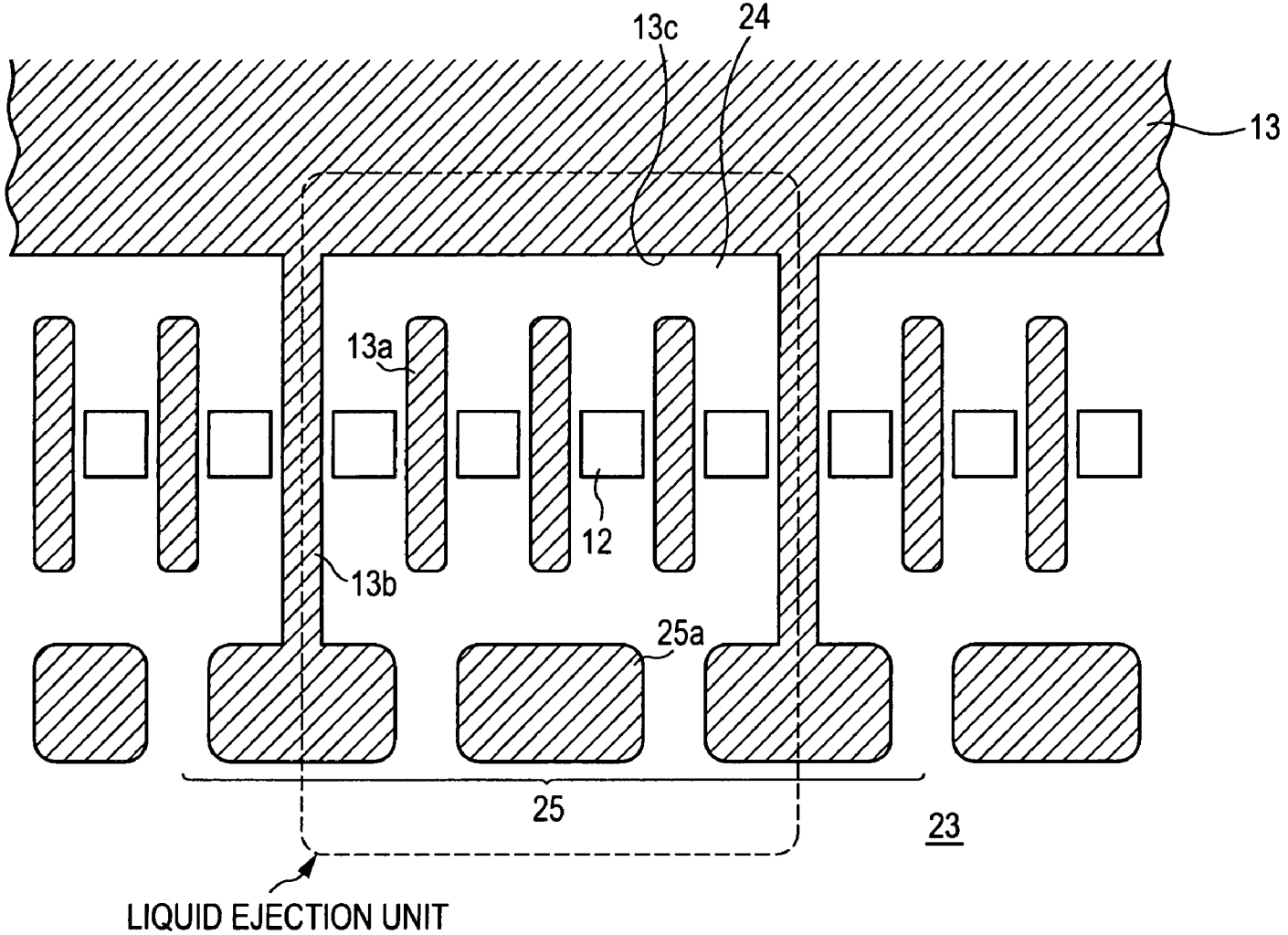
FIG. 20 is a plan view showing the shape of a barrier layer of a head chip as a fourth embodiment of the present invention.

FIG. 20 is a plan view of a fourth embodiment and shows the shape of a barrier layer 33 of a head chip 19.

In the embodiment, N=4. Further, in the embodiment, first, a filter 35 is disposed to a common flow path 23 side. The filter 35 is composed of a plurality of pillars 35*a* disposed at the same pitch. The filter 35 achieves its function by the intervals between the pillars 35*a*, and the intervals between the pillars 35*a* are formed narrower than the interval between partition walls 33*a* or the interval between the partition walls 33*a* and side walls 33*b*.

Further, the ends of the side walls 33*b* on the common flow path 23 side are located farther from heating elements 12 than ends of the partition walls 33*a* on the common flow path 23 side (in other words, extend to the common flow path 23 side). The ends of the side walls 33*b* on the common flow path 23 side are coupled with the pillars 35*a* of the filter 35. In this case, the pitch of the pillars 35*a* is set such that the pillars 35*a* are inevitably located on the lines extending from the side walls 33*b*.

In the embodiment shown in FIG. 20, the pillars 35*a* of the filter 35 are coupled with a pair of the side walls 33*b* as well as one column 35*a* is disposed at a center therebetween. The column 35*a* coupled with the side wall 33*b* also acts as the column 35*a* of the side wall 33*b* of an adjacent liquid ejection unit. Accordingly, when the number of the column 35*a* coupled with one side wall 33*b* is counted as 0.5, the number of the pillars 35*a* in one liquid ejection unit is 2 (=0.5+1+0.5). That is, the embodiment shown in FIG. 20 is a case in which the number (N) of the heating elements 12 is 4, the number of the partition walls 33*a* is 3, and the number of the pillars 35*a* is 2.

When the pillars 35*a* of the filter 35 are coupled with the side walls 33*b* as shown in the embodiment of FIG. 20, the filter 35 can increase the strength of the liquid ejection unit, in particular, the strength of the barrier layer 33 in addition to its role as the filter.

The pillars 35*a* of the filter 35 need not be necessarily coupled with the side walls 33*b* and the size thereof can be arbitrarily determined. However, the interval between the pillars 35*a* must be narrower than the interval between the partition walls 33*a* or the interval between the partition walls 33*a* and the side walls 33*b*. Further, although the pillar 35*a* is composed of a square rod having an approximately rectangular cross section in the embodiment shown in FIG. 20, it is not limited thereto and may be formed in various shapes.

Further, although it is preferable to provide the filter 35, it need not be necessarily provided. That is, it is sufficient to narrow the inlets to the heating elements 12 (liquid chambers) by increasing the thickness of the ends of the partition walls 33*a* and the side walls 33*b* on the common flow path 23 side as shown in, for example, FIG. 18.

However, the provision of the filter 35 not only prevents invasion of dusts and the like but also prevents the partition walls 33*a* (liquid chambers) from being crushed by pressure when the head chip 19 is joined to a nozzle sheet 17.

Figure 21:
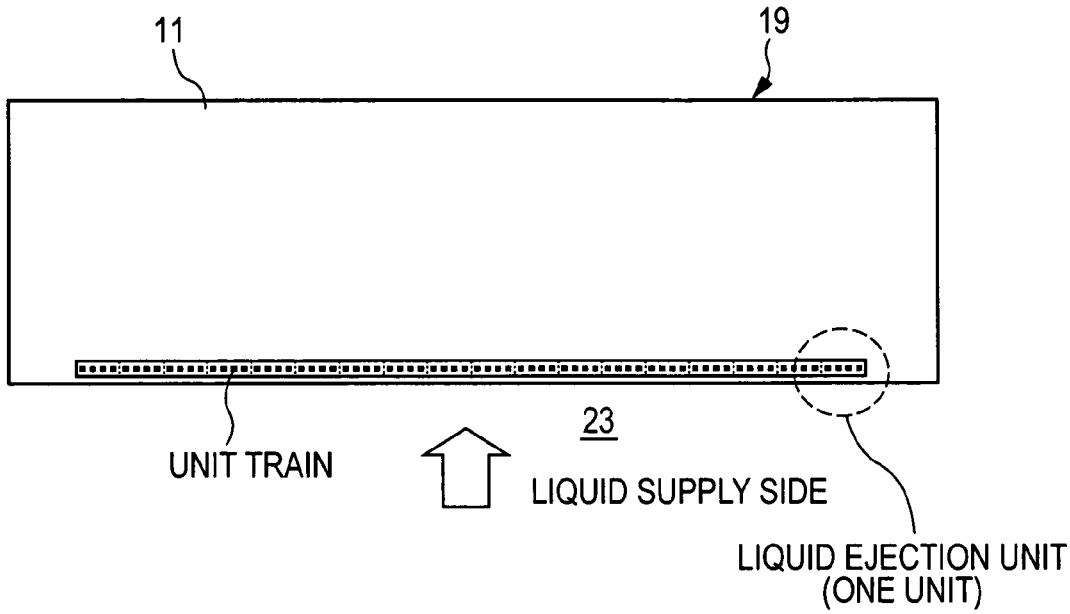
FIG. 21 is a plan view showing an example of a head chip.
Figure 23:
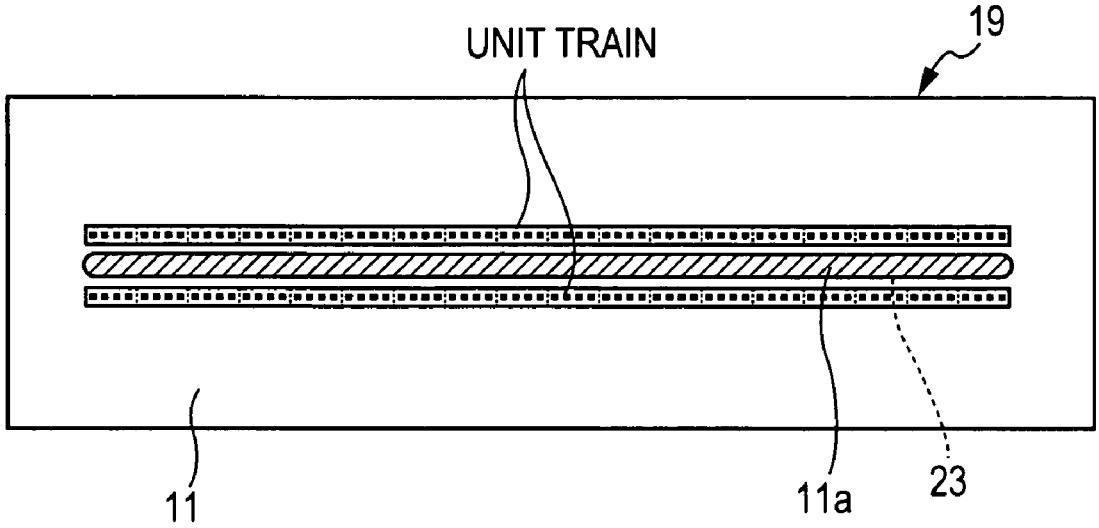
FIG. 23 is a plan view showing still another example of the head chip.

The above structure shown in FIGS. 18 to 20 is disposed on a semiconductor substrate. FIG. 21 is a plan view showing a head chip 19, on which liquid ejection units are disposed side by side, is disposed on a semiconductor substrate 11. FIG. 21 shows one set of the head chip 19 (this is similar in FIGS. 22 and 23 shown below). The head chip 19 is the same as that shown in FIG. 2.

In FIG. 21, a unit train is provided by disposing the liquid ejection units (each constituting one unit) side by side on the outside edge of a side of the semiconductor substrate 11. In the figure, a common flow path 23 is disposed on a liquid supply side of the semiconductor substrate 11, and the liquid is supplied to the respective liquid ejection units from the direction of arrow.

FIG. 22 is a plan view showing a fifth embodiment of the head chip 19. The embodiment of FIG. 22 shows an example of a unit train composed of liquid ejection units disposed side by side to the outside edges of two confronting sides on a semiconductor substrate 11. In the embodiment of FIG. 22, the back surfaces of the liquid ejection units, which are disposed side by side to the outside edge of one side, face the back surfaces of the liquid ejection units, which are disposed side by side to the outside edge of the other side. That is, the central portion on the semiconductor substrate 11 acts as a rear wall 33*c* side. As shown in FIG. 22, liquid supply sides are disposed on the right and left sides in the figure, common flow paths 23 are disposed to the liquid supply sides, respectively, and the liquid is supplied to the respective liquid ejection units from the directions of arrow in the figure.

FIG. 23 is a plan view showing another embodiment of the head chip.

In FIG. 23, a liquid supply hole (slot) 11*a* is formed to a semiconductor substrate 11 so as to pass therethrough from a rear surface side to a front surface side. The liquid supply hole 11*a* communicates with an ink tank and the like (not shown). Unit trains are disposed to confront each other on both the sides of the liquid supply hole 11*a* by disposing liquid ejection units side by side along the liquid supply hole 11*a*.

In this case, since the liquid supply hole 11*a* is disposed along common flow paths 23, the liquid ejection units, which are disposed on both the sides of the liquid supply hole 11*a*, confront each other.

As described above, although there are contemplated the patterns shown in FIGS. 21 to 23 and various patterns other than them as the examples in which the liquid ejection units are disposed on the semiconductor substrate 11, any of the patterns may be employed.

Figure 24:
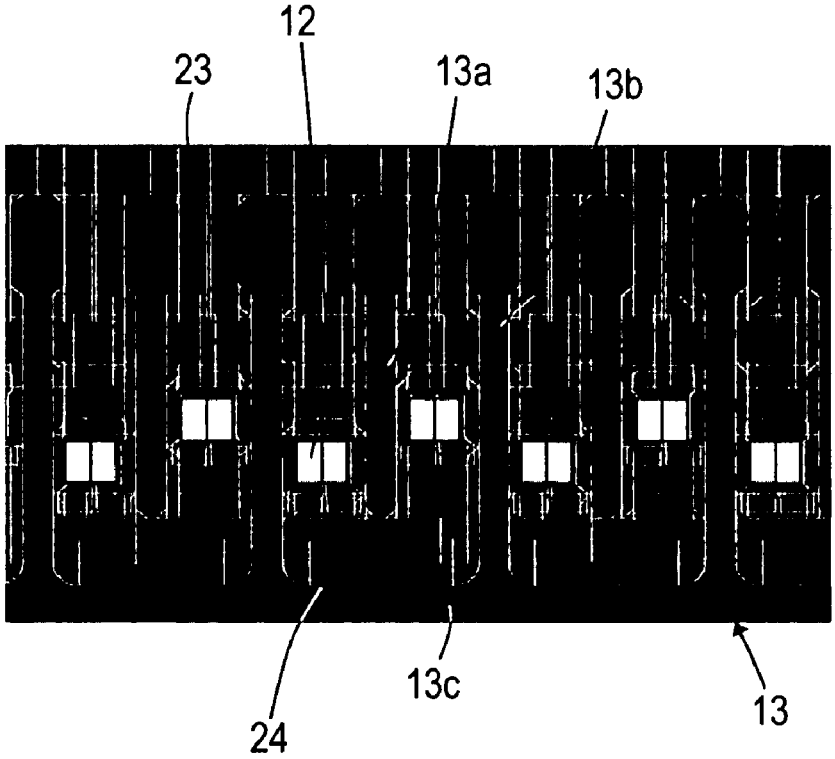
FIG. 24 is a plan view showing a mask view of a head chip manufactured actually.

FIG. 24 is a plan view showing a mask view of a head chip 19 made actually. In FIG. 24, white lines show wiring portions and the like other than a barrier layer 33 disposed on a semiconductor substrate 11. Each of heating elements 12 used in the head chip 19 is separated to one half to execute deflecting ejection of liquid droplets.

Although the heating elements 12 are disposed in one direction at a definite pitch, all the heating elements 12 are not disposed in line (on a straight line), and the centers of adjacent heating elements 12 are displaced at a predetermined interval (real number larger 0) in a direction perpendicular to the direction in which the heating element 12 are disposed at the definite pitch.

With the above arrangement, since the distance between the centers of adjacent nozzles 18 is set to a value larger than the disposing pitch of the heating elements 12, the amount of deformation of nozzles 18 and the peripheral regions thereof due to the pressure fluctuation resulting from ejection of liquid droplets is reduced, thereby the amount ejection and the ejecting direction of liquid droplets can be stabilized.

In FIG. 24, N=2 (two heating elements 12 and one partition walls 33*a* are disposed in one liquid ejection unit) likewise the embodiment of FIG. 18. Further, partition walls 33*a* and side walls 33*b* are partially formed thick on the common flow path 23 side thereof. The partition walls 33*a* and the side walls 33*b* are provided with a function as a filter by the above arrangement. The embodiment is arranged similarly to that shown in FIG. 18 except the above arrangement.

What is claimed is:

1. A liquid ejection unit comprising:

a heating element disposed on a substrate;

a nozzle layer through which a nozzle located over the heating element is formed;

a barrier layer interposed between the substrate and the nozzle layer;

a liquid chamber formed by a part of the barrier layer and having a pair of walls confronting each other with the heating element therebetween;

a pair of individual flow paths formed by extending the pair of walls of the liquid chamber and disposed on both the sides of the liquid chamber so as to communicate with the liquid chamber, wherein a liquid is supplied to the liquid chamber from at least one of the pair of individual flow paths, and a distance U between the pair of walls in the liquid chamber and the flow path width W of the individual flow paths is set to satisfy the relation U>W;

a plurality of the heating elements are arranged on the substrate in one direction;

the liquid chamber and the pair of individual flow paths are disposed in correspondence with each of the heating elements; and the pair of individual flow paths are formed to extend in a direction perpendicular to a direction in which adjacent heating elements are arranged;

wherein the pair of individual flow paths comprises:

a first individual flow path connecting to a common flow path; and a second individual flow path extending in a direction opposite to the first individual flow path across the liquid chamber, wherein the second individual flow paths of at least two adjacent liquid chambers communicate with each other;

the liquid chambers are disposed at a disposing pitch P; and a distance between a first line, which connects centers of the liquid chambers in the direction of the disposing pitch, and a second line which is parallel to the first line and in contact with a wall portion that is farthest from the first line and which is a boundary of the second individual flow paths satisfies the following relation $$L \leqq 2 \times P.$$

2. A liquid ejection unit comprising:

a heating element disposed on a substrate;

a nozzle layer through which a nozzle located over the heating element is formed;

a barrier layer interposed between the substrate and the nozzle layer;

a liquid chamber formed by a part of the barrier layer and having a pair of walls confronting each other with the heating element therebetween;

a pair of individual flow paths formed by extending the pair of walls of the liquid chamber and disposed on both the sides of the liquid chamber so as to communicate with the liquid chamber, wherein a liquid is supplied to the liquid chamber from at least one of the pair of individual flow paths, and the distance U between the pair of walls in the liquid chamber and the flow path width W of the individual flow paths are set to satisfy the relation U>W;

a plurality of the heating elements are arranged on the substrate in one direction;

the liquid chamber and the pair of individual flow paths are disposed in correspondence to each of the heating elements; and the pair of individual flow paths are formed to extend in a direction perpendicular to the direction in which the heating elements are arranged;

wherein the pair of individual flow paths comprises:

a first individual flow path connecting to a common flow path; and a second individual flow path extending in a direction opposite to the first individual flow path across the liquid chamber, wherein the second individual flow paths of at least two adjacent liquid chambers communicate with each other;

a plurality of the liquid chambers are disposed at a disposing pitch P; and centers of adjacent liquid chambers are spaced apart at an interval X (X is a real number larger than 0); and a distance between a first line, which connects centers of the liquid chambers in the direction of the disposing pitch a second line which is parallel to the first line and in contact with a wall portion that is farthest from the first line and which is a boundary of the second individual flow paths satisfies the following relation $$L \leqq 2 \times P.$$

3. A liquid ejection unit comprising:

a heating element disposed on a substrate; a nozzle layer through which a nozzle located above the heating element is formed;

a barrier layer interposed between the semiconductor substrate and the nozzle layer;

a liquid chamber formed by a part of the barrier layer and having a pair of walls confronting each other with the heating element therebetween; and a pair of individual flow paths formed by extending the pair of walls of the liquid chamber and disposed on both the sides of the liquid chamber so as to communicate with the liquid chamber, wherein a liquid is supplied to the liquid chamber from at least one of the pair of individual flow paths, and a distance U between the pair of walls in the liquid chamber and the flow path width W of the individual flow paths are set to satisfy the relation U>W;

a plurality of the heating elements are arranged on the semiconductor substrate in one direction;

the liquid chamber and the pair of individual flow paths are disposed in correspondence to each of the heating elements; and the pair of individual flow paths are formed to extend in a direction approximately perpendicular to the direction in which the heating elements are arranged;

semiconductor substrates disposed in line along a direction in which a plurality of the heating elements are arranged; and a line head is formed by disposing a common flow path, which communicates with all the liquid chambers of the respective semiconductor substrates, in the direction in which the semiconductor substrates are arranged.

4. A liquid ejection unit according to claim 3, wherein:

a plurality of lines of the semiconductor substrates, each of which includes a liquid having different characteristics.

5. A liquid ejection head comprising:

a plurality of heating elements disposed on a semiconductor substrate along one direction;

a nozzle layer through which nozzles located on the heating elements are formed;

a barrier layer interposed between the semiconductor substrate and the nozzle layer;

partition walls formed of a part of the barrier layer and interposed between the heating elements as well as extending in a direction perpendicular to the direction in which the heating elements are arranged and permitting a liquid to flow to the heating elements side from both the sides thereof of a direction perpendicular to the direction in which the heating elements are arranged;

a pair of side walls formed of a part of the barrier layer and disposed to N (N is an integer of at least 2) pieces of heating elements and (N−1) pieces of partition walls externally thereof in parallel with the partition walls; and a rear wall formed of a part of the barrier layer and disposed in the direction in which the heating elements are arranged, wherein when the interval between the partition walls and the rear wall is shown by x, and the interval between the side walls and the rear wall is shown by y, the intervals x and y satisfy the relation $0 \leqq y < x$; and a liquid ejection unit comprises the N pieces of heating elements, the (N−1) pieces of partition walls, a pair of the side walls, and the rear wall, a common flow path is disposed to the heating elements on a side opposite to the rear wall, and a liquid is supplied to the heating elements side of the liquid ejection unit from the common flow path side and from a side opposite to the common flow path side.

6. A liquid ejection unit according to claim 5, wherein $2 \leqq N \leqq 8$.

7. A liquid ejection head according to claim 5, wherein the interval W1 between the partition walls and between the partition wall and the side wall on the region of the heating element and the interval W2 between the partition walls and between the partition wall and the side wall at the end of the common flow path satisfies the following condition $$W2 < W1.$$

8. A liquid ejection head according to claim 5, wherein the ends of the side walls on the common flow path side are located farther from the heating elements than ends of the partition walls on the common flow path side.

9. A liquid ejection head according to claim 5, wherein a plurality of the liquid ejection units are disposed on the single semiconductor substrate as well as all the nozzles of a plurality of the liquid ejection units are disposed at a definite pitch.

10. A liquid ejection head according to claim 9, wherein the plurality of the liquid ejection units are disposed to the outside edge of a side of the semiconductor substrate.

11. A liquid ejection head according to claim 9, wherein the plurality of the liquid ejection units are disposed to the outside edges of two confronting sides of the semiconductor substrate.

12. A liquid ejection head according to claim 9, wherein a slot is formed to the semiconductor substrate so as to pass therethrough from a rear surface side to a front surface side; and a plurality of the liquid ejection units are disposed to confront each other along the slot on both the sides thereof.

13. A liquid ejection unit according to claim 5, wherein the semiconductor substrates are disposed in line along the direction in which the heating elements are arranged, and a line head is formed by disposing the common flow path of the respective semiconductor substrates in the direction in which the semiconductor substrate are disposed.

14. A liquid ejection unit according to claim 13, wherein:

a plurality of lines of the semiconductor substrates, each of which includes the semiconductor substrates disposed in line, are disposed in column; and a liquid having different characteristics is supplied to the semiconductor substrates in one column and to a plurality of the semiconductor substrates in other column.

15. A liquid ejection device comprising:

a plurality of heating elements disposed on a semiconductor substrate along one direction;

a nozzle layer through which nozzles located on the heating elements are formed;

a barrier layer interposed between the semiconductor substrate and the nozzle layer;

partition walls formed of a part of the barrier layer and interposed between the heating elements as well as extending in a direction perpendicular to the direction in which the heating elements are arranged and permitting a liquid to flow to the heating elements side from both the sides thereof of a direction perpendicular to the direction in which the heating elements are arranged;

a pair of side walls formed of a part of the barrier layer and disposed to N (N is an integer of at least 2) pieces of heating elements and (N−1) pieces of partition walls externally thereof in parallel with the partition walls; and a rear wall formed of a part of the barrier layer and disposed in the direction in which the heating elements are arranged, wherein when the interval between the partition walls and the rear wall is shown by x, and the interval between the side walls and the rear wall is shown by y, the intervals x and y satisfy the relation $0 \leqq y < x$; and a liquid ejection unit comprises the N pieces of heating elements, the (N−1) pieces of partition walls, a pair of the side walls, and the rear wall, a common flow path is disposed to the heating elements on a side opposite to the rear wall, and a liquid is supplied to the heating elements side of the liquid ejection unit from the common flow path side and from a side opposite to the common flow path side.

* * * * *